US007646361B2

(12) United States Patent
Jung

(10) Patent No.: US 7,646,361 B2
(45) Date of Patent: Jan. 12, 2010

(54) PLASMA DISPLAY APPARATUS AND DRIVING METHOD THEREOF

(75) Inventor: Yunkwon Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 674 days.

(21) Appl. No.: 11/269,649

(22) Filed: Nov. 9, 2005

(65) Prior Publication Data

US 2006/0109208 A1 May 25, 2006

(30) Foreign Application Priority Data

Nov. 19, 2004 (KR) ..... 10-2004-0095455
Jul. 27, 2005 (KR) ..... 10-2005-0068668

(51) Int. Cl.
*G09G 3/28* (2006.01)

(52) U.S. Cl. ..... 345/68; 345/60

(58) Field of Classification Search ..... 345/55–100, 345/204–214

See application file for complete search history.

(56) References Cited

U.S. PATENT DOCUMENTS

| | | | | |
|---|---|---|---|---|
| 6,677,714 | B2 * | 1/2004 | Du et al. | 315/169.4 |
| 7,068,243 | B2 * | 6/2006 | Morimoto | 345/60 |
| 7,271,782 | B2 * | 9/2007 | Yoon et al. | 345/60 |
| 7,358,931 | B2 * | 4/2008 | Mizobata et al. | 345/60 |
| 7,417,604 | B2 * | 8/2008 | Kim | 345/63 |
| 7,508,359 | B2 * | 3/2009 | Han | 345/60 |
| 2001/0017605 | A1 | 8/2001 | Hashimoto et al. | 345/60 |
| 2002/0195963 | A1 | 12/2002 | Tokunaga et al. | 315/169.3 |
| 2003/0080927 | A1 * | 5/2003 | Sim et al. | 345/60 |
| 2004/0108975 | A1 | 6/2004 | Araki | 345/63 |
| 2005/0088375 | A1 | 4/2005 | Son | 345/60 |
| 2006/0103599 | A1 * | 5/2006 | Cho et al. | 345/67 |

FOREIGN PATENT DOCUMENTS

| | | |
|---|---|---|
| EP | 1 265 212 A1 | 12/2002 |
| EP | 1 388 841 A2 | 2/2004 |
| EP | 1 503 192 A1 | 2/2005 |
| EP | 1 659 558 A2 | 5/2006 |
| JP | 2001-318649 | 11/2001 |

* cited by examiner

*Primary Examiner*—David L Lewis
(74) *Attorney, Agent, or Firm*—KED & Associates, LLP

(57) ABSTRACT

The present invention relates to a plasma display apparatus and driving method thereof. The plasma display apparatus according to the present invention comprises a Plasma Display Panel (PDP) including scan electrodes and sustain electrodes, a driver that supplies a pre-reset waveform to the scan electrodes or the sustain electrodes prior to a reset period of one or more sub-fields, and a controller that controls a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP.

25 Claims, 15 Drawing Sheets

PLASMA DISPLAY APPARATUS AND DRIVING METHOD THEREOF

CROSS-REFERENCE TO RELATED APPLICATIONS

This Nonprovisional application claims priority under 35 U.S.C. § 119(a) on Patent Application Nos. 10-2004-0095455 and 10-2005-0068668 filed in Korea on Nov. 19, 2004 and Jul. 27, 2005, the entire contents of which are hereby incorporated by reference.

BACKGROUND OF THE INVENTION

1. Field of the Invention

The present invention relates to a plasma display apparatus and a driving method thereof.

2. Background of the Related Art

In general, a plasma display apparatus displays images by light-emitting phosphors with ultraviolet generated during the discharge of an inert mixed gas such as He+Xe, Ne+Xe or He+Ne+Xe. This plasma display apparatus can be manufactured to be thin and have a large screensize. The picture quality of the plasma display apparatus has improved given recent technological developments.

To implement the gray scales of images, a plasma display apparatus is time-driven with one frame being divided into several sub-fields having a different number of emissions. Each of the sub-fields is divided into a reset period for initializing the entire screen, an address period for selecting a scan line and selecting a discharge cell from the selected scan line and a sustain period for implementing the gray scales depending on the number of discharges.

For example, to display an image with 256 gray scales, a frame period (16.67 ms) corresponding to 1/60 seconds is divided into eight sub-fields (SF1 to SF8), as shown in FIG. 1. Each of the eight sub-fields (SF1 to SF8) is divided into an initialization period, an address period and a sustain period. The initialization period and the address period of each of the sub-fields are the same for every sub-field. The sustain period and the number of sustain pulses allocated thereto increase in the ratio of $2^n$ (n=0,1,2,3,4,5,6,7) in each sub-field.

FIG. 2 schematically shows the arrangements of electrodes of a three-electrode AC surface discharge type plasma display panel (hereinafter, referred to as "P(DP)") in the related art.

Referring to FIG. 2, the conventional three-electrode AC surface discharge type P(DP) comprises scan electrodes Y1 to Yn and sustain electrodes Z formed on an upper substrate and address electrodes X1 to Xm formed on a lower substrate to intersect the scan electrodes Y1 to Yn and the sustain electrodes Z.

Discharge cells 1 for displaying one of red, green or blue visible rays are disposed at the intersections of the scan electrodes Y1 to Yn, the sustain electrodes Z and the address electrodes X1 to Xm in matrix form.

A dielectric layer (not shown) and an MgO protection layer (not shown) are formed on the upper substrate in which the scan electrodes Y1 to Yn and the sustain electrodes Z are formed.

Barrier ribs for preventing optical and electrical interference among neighboring discharge cells 1 are formed on the lower substrate in which the address electrodes X1 to Xm are formed. Phosphors, which are excited by ultraviolet ray to emit a visible ray, are formed on the surfaces of the lower substrate and the barrier ribs.

An inert mixed gas, such as He+Xe, Ne+Xe or He+Xe+Ne, is injected into discharge spaces partitioned between the upper substrate and the lower substrate of the P(DP).

FIG. 3 shows a driving waveform supplied to the P(DP) as shown in FIG. 2. The driving waveform of FIG. 3 will be described with reference to the wall charge distribution of FIGS. 4*a* to 4*e*.

Referring to FIG. 3, each of the sub-fields (SFn−1, SFn) comprises a reset period (RP) for initializing the discharge cells 1 of the entire screen, an address period (AP) for selecting discharge cells, a sustain period (SP) for sustaining the discharge of selected discharge cells 1, and an erase period (EP) for erasing wall charges within the discharge cells 1.

In the erase period (EP) of the $(n-1)^{th}$ sub-field (SFn−1), an erase ramp waveform (ERR) is applied to the sustain electrodes Z. during the erase period (EP), 0V is applied to the scan electrodes Y and the address electrodes X. The erase ramp waveform (ERR) is a positive ramp waveform whose voltage gradually rises from 0V to a positive sustain voltage (Vs). An erase discharge is generated between the scan electrodes Y and the sustain electrodes Z within on-cells in which the sustain discharge is generated by the erase ramp waveform (ERR). Wall charges within the on-cells are erased by the erase discharge. As a result, each of the discharge cells 1 has the wall charge distribution as shown in FIG. 4*a* soon after the erase period (EP).

In a set-up period (SU) of the reset period (RP) where the $n^{th}$ sub-field (SFn) begins, a positive ramp waveform (PR) is applied to all the scan electrodes Y, and 0V is applied to the sustain electrodes Z and the address electrodes X. A voltage on the scan electrodes Y gradually rises from the positive sustain voltage (Vs) to a reset voltage (Vr), which is higher than the positive sustain voltage (Vs), by means of the positive ramp waveform (PR) of the set-up period (UP). A dark discharge is generated between the scan electrodes Y and the address electrodes X within the discharge cells of the entire screen as well as between the scan electrodes Y and the sustain electrodes Z by means of the positive ramp waveform (PR).

As a result of the dark discharge, positive wall charges remain on the address electrodes X and the sustain electrodes Z immediately after the set-up period (SU), and negative wall charges remain on the scan electrodes Y, as shown in FIG. 4*b*. While the dark discharge is generated in the set-up period (SU), a gap voltage (Vg) between the scan electrodes Y and the sustain electrodes Z and a gap voltage between the scan electrodes Y and the address electrodes X are initialized to a voltage close upon a firing voltage (Vf) which can generate a discharge.

In a set-down period (SD) of the reset period (RP) after the set-up period (SU), a negative ramp waveform (NR) is applied to the scan electrodes Y. At the same time, the positive sustain voltage (Vs) is applied to the sustain electrodes Z and 0V is applied to the address electrodes X. A voltage on the scan electrodes Y gradually falls from the positive sustain voltage (Vs) to a negative erase voltage (Ve) by means of the negative ramp waveform (NR).

A dark discharge is generated between the scan electrodes Y and the sustain electrodes Z as well as between the scan electrodes Y and the address electrodes X within the discharge cells of the entire screen by means of the negative ramp waveform (NR). As a result of the dark discharge of the set-down period (SD), the wall charge distribution within each of the discharge cells 1 is changed to an optimal address condition, as shown in FIG. 4*c*. Except for a predetermined amount of required wall charges, excessive wall charges unnecessary for an address discharge are erased from the scan electrodes Y and the address electrodes X within each of the discharge cells 1.

The polarity of the wall charges on the sustain electrodes Z inverts from a positive polarity to a negative polarity as negative wall charges move from the scan electrodes Y accumulate on the sustain electrodes Z. While the dark discharge is generated in the set-down period (SD) of the reset period (RP), a gap voltage between the scan electrodes Y and the sustain electrodes Z and a gap voltage between the scan electrodes Y and the address electrodes X becomes close to the firing voltage (Vf).

In the address period (AP), while negative scan pulses (−SCNP) are sequentially applied to the scan electrodes Y, a positive data pulse (DP) is applied to the address electrodes X in synchronization with the scan pulse (−SCNP). A voltage of the scan pulse (−SCNP) is a scan voltage (Vsc), which falls from 0V or a negative scan bias voltage (Vyb) to about a 0V to a negative scan voltage (−Vy). A voltage of the data pulse (DP) is a positive data voltage (Va). During the address period (AP), a positive Z bias voltage (Vzb), which is lower than the positive sustain voltage (Vs), is applied to the sustain electrodes Z.

In a state where the gap voltage is adjusted to a voltage of about to the firing voltage (Vf) immediately after the reset period (RP), an address discharge is generated between the scan electrodes Y and the address electrodes X while the gap voltage between the electrodes Y and X exceeds the firing voltage (Vf) within on-cells to which the scan voltage (Vsc) and the data voltage (Va) are applied. The first address discharge between the scan electrode Y and the address electrode X generates priming charged particles within the discharge cells, and thus induces a second discharge between the scan electrodes Y and the sustain electrodes Z, as shown in FIG. 4*d*. The wall charge distribution within on-cells in which the address discharge is generated is shown in FIG. 4*e*.

The wall charge distribution within off-cells in which the address discharge is not generated substantially keeps the state shown in FIG. 4*c*.

In the sustain period (SP), sustain pulses (SUSP) of a positive sustain voltage (Vs) are alternately applied to the scan electrodes Y and the sustain electrodes Z. A sustain discharge is generated between the scan electrodes Y and the sustain electrodes Z within on-cells selected by the address discharge every sustain pulse (SUSP) owing to the wall charge distribution of FIG. 4*e*. However, a discharge is not generated within off-cells during the sustain period. This is because the gap voltage between the scan electrodes Y and the sustain electrodes Z cannot exceed the firing voltage (Vf) when the first positive sustain voltage (Vs) is applied to the scan electrodes Y since the wall charge distribution of the off-cells remains in the state shown in FIG. 4*c*.

In the conventional plasma display apparatus, however, several discharges are generated to control the initialization and wall charges of the discharge cells 1 through the erase period (EP) of the $(n-1)^{th}$ sub-field (SFn−1) and the reset period (RP) of the $n^{th}$ sub-field (SFn). Therefore, problems arise because a dark room contrast value decreases and the contrast ratio decreases accordingly. Table 1 below shows the type and number of discharges, which are generated in the erase period (EP) and the reset period (RP) of the previous sub-field (SFn−1) in the conventional plasma display apparatus.

TABLE 1

| | | Operating Time | | |
|---|---|---|---|---|
| | | | RP of SFn | |
| Cell State | | EP of SFn − 1 | SU | SD |
| On-cells turned on in SFn − 1 | Counter Discharge (Y-X) | X | ○ | ○ |
| | Surface Discharge (Y-Z) | ○ | ○ | ○ |
| Off-cells turned off in SFn − 1 | Counter Discharge (Y-X) | X | ○ | ○ |
| | Surface Discharge (Y-Z) | X | ○ | ○ |

As shown in Table 1, the on-cells that are turned on in the $(n-1)^{th}$ sub-field (SFn−1) generate three surface discharges between the scan electrodes Y and the sustain electrodes Z and two counter discharges between the scan electrodes Y and the address electrodes X, while during the erase period (EP) and the reset period (RP). The off-cells that are turned off in the previous sub-field (SFn) generate two surface discharges between the scan electrodes Y and the sustain electrodes Z and two counter discharges between the scan electrodes Y and the address electrodes X, during the erase period (EP) and the reset period (RP).

Multiple discharges, which are generated in the erase period and in the reset period, increase the amount of light emission in the erase period and in the reset period even though the amount of light emission should be minimized to maintain proper contrast, thereby causing the dark room contrast value to decreases. More particularly, since the amount of light emission in the surface discharge between the scan electrodes Y and the sustain electrodes Z is more than the amount of light emission in the counter discharge between the scan electrodes Y and the address electrodes X, the amount of light in the surface discharge has a substantially adverse effect on the dark room contrast.

In the conventional plasma display apparatus, wall charges are not smoothly erased in the erase period (EP) of the $(n-1)^{th}$ sub-field (SFn−1). Therefore, if negative wall charges are excessively accumulated on the scan electrodes Y, a dark discharge is not generated in the set-up period (SU) of the nth sub-field (SFn). If the dark discharge is not generated in the set-up period (SU) as described above, discharge cells are not initialized. In this case, to generate a discharge in the set-up period, the reset voltage (Vr) should be high.

If a dark discharge is not generated in the set-up period (SU), a condition within the discharge cells immediately after the reset period does not become an optimal address condition. This results in an abnormal discharge or an erroneous discharge.

If positive wall charges are excessively accumulated on the scan electrodes Y soon after the erase period (EP) of the $(n-1)^{th}$ sub-field (SFn−1), a strong discharge is generated when the positive sustain voltage (Vs), i.e., a start voltage of the positive ramp waveform (PR), is applied to the scan electrodes Y in the set-up period (SU) of the $n^{th}$ sub-field (SFn). Therefore, initialization is not uniform in all of the cells. This problem will be described below in detail with reference to FIG. 5.

FIG. 5 shows an externally applied voltage (Vyz) between the scan electrodes Y and the sustain electrodes Z in the set-up period (SU) and a gap voltage (Vg) within a discharge cell. The externally applied voltage (Vyz) indicated by a solid line in FIG. 5 is an external voltage applied to the scan electrodes Y and the sustain electrodes Z, respectively. Since the externally applied voltage (Vyz) of 0V is applied to the sustain electrodes Z, it is substantially the same as a voltage of the positive ramp waveform (PR). In FIG. 5, dotted lines ①, ② and ③ indicate gap voltages (Vg) formed in a discharge gas by the wall charges within the discharge cell.

The gap voltages (Vg) are different as indicated by dotted lines ①, ② and ③ because the amount of wall charges within the discharge cells is different depending on whether a discharge has occurred in a previous sub-field. The relationship between the externally applied voltage (Vyz) between the scan electrodes Y and the sustain electrodes Z and the gap voltage (Vg) formed in the discharge gas within the discharge cell can be expressed in the following Equation 1.

$$Vyz=Vg+Vw \quad \text{[Equation 1]}$$

In FIG. 5, the gap voltage (Vg) of ① Defers to a case where wall charges within a discharge cell are sufficiently erased and the wall charges are sufficiently small. The gap voltage (Vg) increases in proportion to the externally applied voltage (Vyz), but generates a dark discharge if the gap voltage is about equal the firing voltage (Vf). The gap voltage within the discharge cells is initialized to the firing voltage (Vf) by the dark discharge.

In FIG. 5, the gap voltage (Vg) of ② refers to a case where a strong discharge is generated during the erase period (EP) of the $(n-1)^{th}$ sub-field (SFn−1) and thus inverts the polarity of the wall charges in the wall charge distribution within the discharge cells. The polarity of wall charges accumulated on the scan electrodes Y soon after the erase period (EP) is inverted to a positive polarity because of the strong discharge.

Such a case is generated when the uniformity of discharge cells is low or the slope of the erase ramp waveform (ERR) is varies as the temperature fluctuates in a large sized PDP. In this case, as the initial gap voltage (Vg) rises too much as indicated by ② of FIG. 5, the gap voltage (Vg) exceeds the firing voltage (Vf) while the positive sustain voltage (Vs) is applied to the scan electrodes Y in the set-up period (SU). Therefore, a strong discharge is generated.

Since the discharge cells are not initialized to the wall charge distribution of an optimal address condition, i.e., the wall charge distribution of FIG. 4*c* by means of the strong discharge in the set-up period (SU) and the set-down period (SD), an address discharge may be generated in off-cells that should be turned off. In other words, if a strong erase discharge is generated in the erase period prior to the reset period, an erroneous discharge can be generated.

In FIG. 5, the gap voltage (Vg) of ③ refers to a case where a wall charge distribution within discharge cells, which are formed as a result of a sustain discharge generated immediately before an erase discharge, remains intact because the erase discharge is not generated or a very weak erase discharge is generated during the erase period (EP) of the $(n-1)^{th}$ sub-field (SFn−1). This will be described in more detail below. As shown in FIG. 3, the last sustain discharge is generated when the sustain pulse (SUSP) is applied to the scan electrodes Y.

As a result of the last sustain discharge, negative wall charges remain on the scan electrodes Y and positive wall charges remain on the sustain electrodes Z. However, although these wall charges must be erased for initialization to be normally performed in a next sub-field, the polarity of the wall charges remains intact if the erase discharge is not generated or a very weak discharge generated.

The reason why the erase discharge is not generated or a very weak erase discharge is generated is that the uniformity of discharge cells in a PDP is very low or the slope of the erase ramp waveform (ERR) has changed as a result of temperature fluctuations. In this case, since the initial gap voltage (Vg) is very low, i.e., a negative polarity as shown in ③ of FIG. 5, the gap voltage (Vg) within the discharge cells does not equal the firing voltage (Vf) even if the positive ramp waveform (PR) rises up to the reset voltage (Vr) in the set-up period. Therefore, a dark discharge is not generated in the set-up period (SU) and the set-down period (SD). Consequently, if an erase discharge is not generated or a very weak erase discharge is generated in the erase period prior to the reset period, an erroneous discharge or an abnormal discharge is generated because initialization is not adequately performed.

In the case of ② in FIG. 5, the relation between the gap voltage (Vg) and the firing voltage (Vf) can be expressed in the following Equation 2. In the case of ③ in FIG. 5, the relation between the gap voltage (Vg) and the firing voltage (Vf) can be expressed in the following Equation 3.

$$Vgini+Vs>Vf \quad \text{[Equation 2]}$$

$$Vgini+Vr<Vf \quad \text{[Equation 3]}$$

where Vgini is an initial gap voltage immediately before the set-up period (SU) as shown in FIG. 5.

In consideration of the above described problem, a gap voltage condition (or a wall voltage condition) for enabling initialization to be normally performed in the erase period (EP) and the reset period (RP) can be expressed in the following Equation 4, which fulfills both the equations 2 and 3.

$$Vf-Vr<Vgini<Vf-Vs \quad \text{[Equation 4]}$$

If the initial gap voltage (Vgini) does not fulfill the condition of Equation 4 prior to the set-up period (SU), the conventional plasma display apparatus will generate an erroneous discharge, miss-discharge or abnormal discharge, and will have a narrow operational margin. In other words, to secure operational reliability and an operational margin in the conventional plasma display apparatus, an erase operation in the erase period (EP) must be performed. However, the erase operation can be performed abnormally depending on the uniformity of discharge cells and a use temperature of a PDP, as described above.

In the conventional plasma display apparatus, an erroneous discharge, miss-discharge or an abnormal discharge can be generated due to excessive spatial charges occurring under a high-temperature environment and an unstable wall charge distribution due to the amount of active motion of the spatial charges. Therefore, a problem arises because the operational margin decreases. This will be described in detail in connection with FIGS. 6*a* to 6*c*.

The amount of spatial charges generated upon discharge and the amount of motion of the spatial charges under a high-temperature environment, are more than those at room temperature or a low temperature. Therefore, in a sustain discharge of a $(n-1)^{th}$ sub-field (SFn−1), substantial number of spatial charges are generated. Many of the spatial charges 61 within the discharge space remain active even immediately after the set-up period (SU) of the $n^{th}$ sub-field (SFn), as shown in FIG. 6*a*.

If the data voltage (Va) is applied to the address electrodes X and the scan voltage (−Vy) is applied to the scan electrodes Y during the address period when there is active motion of the spatial charges 61 within the discharge space as shown in FIG. 6*a*, the negative spatial charges 61 are recombined with negative wall charges that have accumulated on the scan electrodes Y as a result of the set-up discharge in the set-up period (SU). The negative spatial charges 61 are recombined with positive wall charges that have been accumulated on the address electrodes Y as a result of the set-up discharge of the set-up period (SU), as shown in FIG. 6*b*.

As a result, as shown in FIG. 6*c*, the negative wall charges on the scan electrodes Y, which have been formed by the set-up discharge, and the positive wall charges on the address electrodes X, which have been formed by the set-up discharge, are erased. Although the data voltage (Va) and the scan voltage (−Vy) are applied to the address electrodes X and the scan electrodes Y, the gap voltage (Vg) does not equal the firing voltage (Vf). Therefore, an address discharge is not generated.

Therefore, in the case where the driving waveform as shown in FIG. 3 is applied to a PDP used in a high temperature environment, a problem arises because miss-writing of on-cells is frequently occurs.

SUMMARY OF THE INVENTION

Therefore, the present invention has been made in view of the above problems, and it is an object of the present invention to provide a plasma display apparatus and a driving method thereof, in which a discharge will be stabilized under a high-temperature environment.

A plasma display apparatus according to the present invention comprises a PDP including scan electrodes and sustain electrodes, a driver that supplies a pre-reset waveform to the scan electrodes or the sustain electrodes prior to a reset period of one or more sub-fields, and a controller that controls a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP.

A driving method of a plasma display apparatus that drives a PDP including scan electrodes and sustain electrodes according to the present invention comprises the steps of supplying a pre-reset waveform prior to the scan electrodes or the sustain electrodes prior to a reset period, and controlling a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP.

The present invention is advantageous in that a stable discharge can be performed without miss-writing when a PDP is driven un a high temperature environment.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
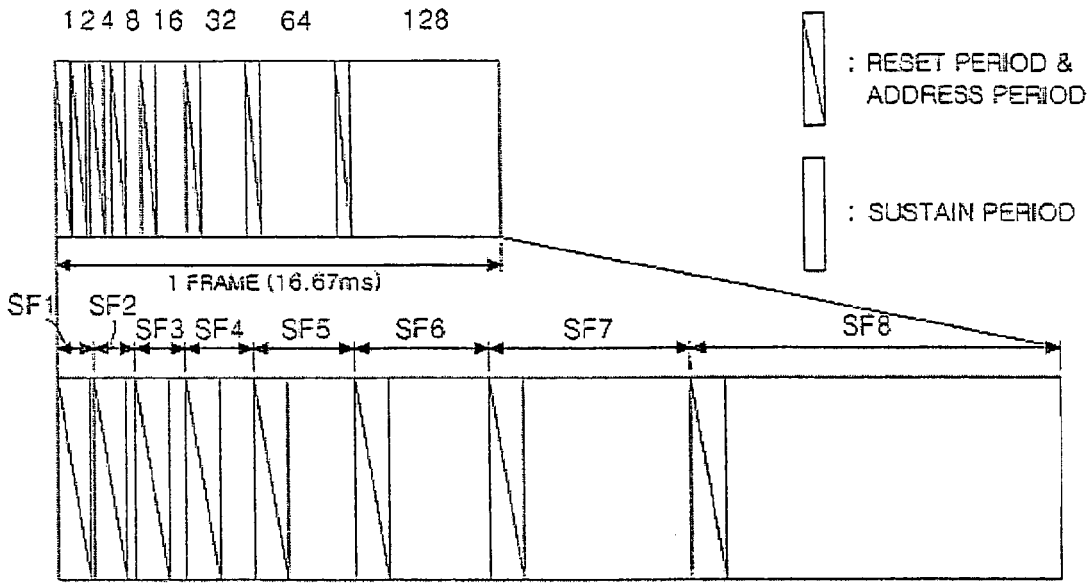
FIG. 1 shows a sub-field pattern of a 8-bit default code for implementing 256 gray scales in a plasma display apparatus.

Preferred embodiments of the present invention will be described in a more detailed manner with reference to the drawings.

A plasma display apparatus according to the present invention comprises a PDP including scan electrodes and sustain electrodes, a driver that supplies a pre-reset waveform to the scan electrodes or the sustain electrodes prior to a reset period of one or more sub-fields, and a controller that controls a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP.

The controller may set the period between the last sustain pulse, which is generated during the sustain period of the $(n-1)^{th}$ sub-field (where n is a positive integer), and the initialization signal, which is generated during the reset period of the $n^{th}$ sub-field, to be longer than that at room temperature as a temperature of the PDP or an ambient temperature of the PDP becomes high.

The length of the period of time between the last sustain pulse generated during the sustain period of the $(n-1)^{th}$ sub-field and the initialization signal generated during the reset period of the $n^{th}$ sub-field is set to be in the range of approximately 100 μs to 1 ms.

The controller may sets the length of time of a rising period and a falling period of the sustain pulse to be in the range of approximately 320 ns to 360 ns when the temperature of the PDP or the ambient temperature of the PDP is higher than room temperature.

A width of the last sustain pulse is set to 1 μs to 1 ms.

After the last sustain pulse is applied to the scan electrodes or the sustain electrodes, a voltage of the scan electrodes or the sustain electrodes may be maintained at a ground level voltage.

A length of a period where the voltage of the scan electrodes or the sustain electrodes is maintained at a ground level voltage is set to 100 μs to 1 ms.

The pre-reset waveform may be supplied prior to a reset period of at least one of a plurality of sub-fields of a frame.

The pre-reset waveform may be supplied prior to a reset period of a sub-field having the lowest gray scale weight, of the plurality of sub-fields of the frame.

A plasma display apparatus according to the present invention comprises a PDP including scan electrodes and sustain electrodes, a driver that supplies a pre-reset waveform to the scan electrodes or the sustain electrodes prior to a reset period of one or more sub-fields, and a controller that controls a distance between a supply point of a last sustain pulse supplied to the scan electrodes or the sustain electrodes and a supply point of an initialization signal of a next sub-field when a temperature of the PDP or an ambient temperature of the PDP is substantially high.

The high temperature of the temperature of the PDP or the ambient temperature of the PDP may be 40° C. or higher.

The distance between the supply point of the last sustain pulse and the supply point of the initialization signal of a next sub-field is dependent base on width of the last sustain pulse.

The width of the last sustain pulse is set to 1 μs to 1 ms.

After the last sustain pulse is applied to the scan electrodes or the sustain electrodes, a voltage of the scan electrodes or the sustain electrodes is maintained at a ground level voltage.

A driving method of a plasma display apparatus that drives a PDP including scan electrodes and sustain electrodes according to the present invention comprises the steps of supplying a pre-reset waveform prior to the scan electrodes or the sustain electrodes prior to a reset period, and controlling a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP.

The period between the last sustain pulse generated during the sustain period of the $(n-1)^{th}$ sub-field and the initialization signal generated during the reset period of the $n^{th}$ is set to be in the range of approximately 100 μs to 1 ms.

A rising period and a falling period of the sustain pulse applied to the scan electrodes or the sustain electrodes during the sustain period is set to approximately 320 ns to 360 ns.

A width of the last sustain pulse is set to 1 μs to 1 ms.

After the last sustain pulse is applied to the scan electrodes or the sustain electrodes is finished, a voltage of the scan electrodes or the sustain electrodes is maintained at a ground level voltage.

A length of a period where the voltage of the scan electrodes or the sustain electrodes are ground level voltage is set to 100 μs to 1 ms.

A plasma display apparatus and driving method thereof according to the present invention will be described below with reference to the accompanying drawings.

Figure 7:
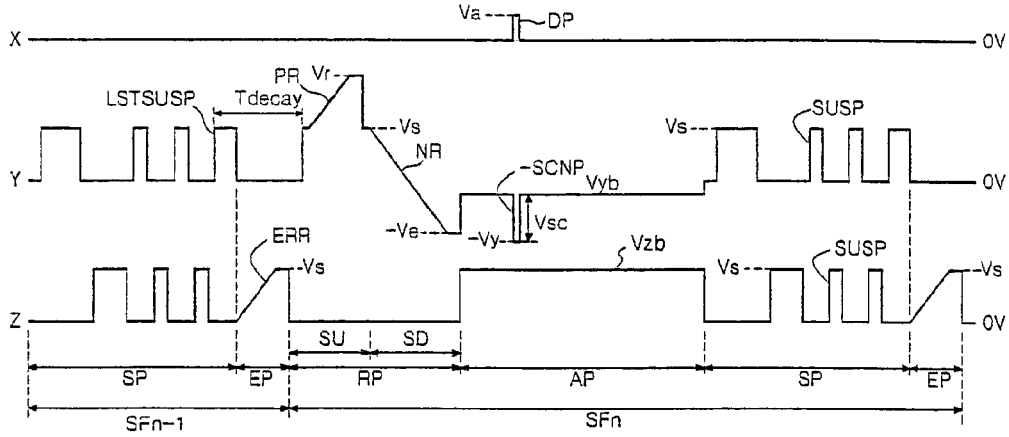
FIG. 7 shows a waveform illustrating a driving method of a plasma display apparatus according to a first embodiment of the present invention.

FIG. 7 shows a waveform illustrating a driving method of a plasma display apparatus according to a first embodiment of the present invention. The driving waveform of FIG. 7 can be applied to the three-electrode AC surface discharge type PDP shown in FIG. 2.

Referring to FIG. 7, each of sub-fields (SFn−1, SFn) comprises a reset period (RP) for initializing discharge cells of the entire screen, an address period (AP) for selecting discharge cells, a sustain period (SP) for sustaining the discharge of selected discharge cells, and an erase period (EP) for erasing wall charges within the discharge cells.

Figure 3:
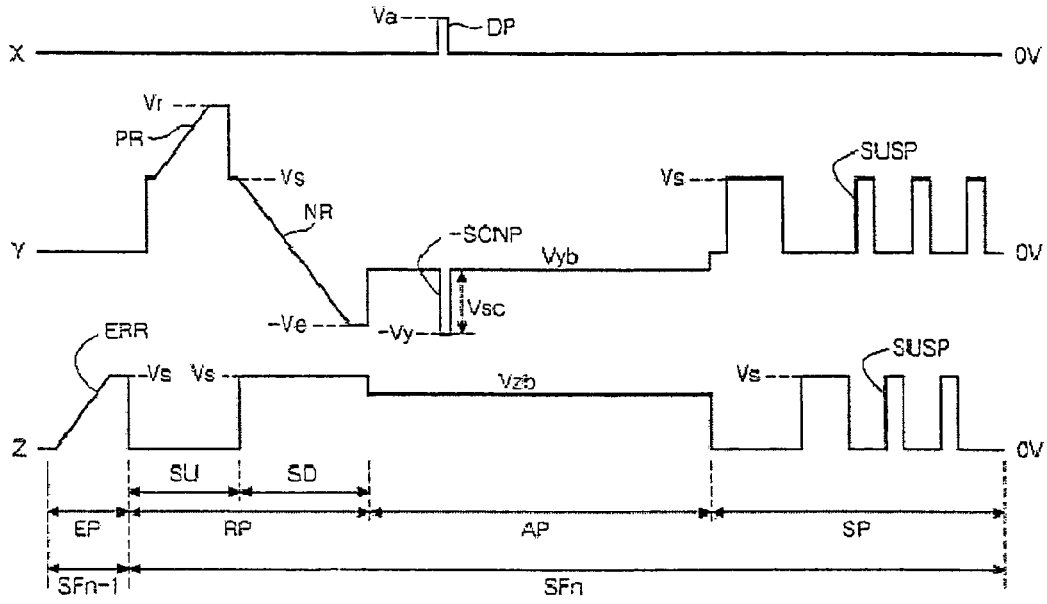
FIG. 3 shows a driving waveform of a typical PDP.

The reset period (RP), the address period (AP) and the sustain period (SP) are substantially the same as those of the driving waveform shown in FIG. 3. Description thereof will be omitted. The bias voltage (Vzb) supplied to the sustain electrodes of the driving method of the plasma display apparatus according to the present invention can also be applied to the sustain electrodes from a set-down period of the reset period to the address period. However, as shown in FIG. 7, the bias voltage (Vzb) can be supplied to the sustain electrodes after the set-down period has ended, and then maintained during the address period.

In the driving method of the plasma display apparatus according to the present invention, at a high temperature of 40° C. or higher, a spatial charge decay period (Tdecay) for inducing decay of spatial charges is set between a rising point of a last sustain pulse (LSTSUSP) of a (n−1).sup.th sub-field (SFn−1) and a rising point of a positive ramp waveform (PR) where the reset period (RP) of the n.sup.th sub-field (SFn) begins. The spatial charge decay period (Tdecay) is set to be longer at a high temperature of 40° C. than at a room temperature environment, and has a time length of approximately 100 μs to 1 ms.

A width of the last sustain pulse is 1 μs to 1 ms.

The last sustain pulse can also be applied to the sustain electrodes. In addition, during a predetermined time after the last sustain pulse is applied to the scan electrodes or the sustain electrodes, the scan electrodes or the sustain electrodes are maintained at a ground level voltage. The time length of the period where the voltage of the scan electrodes or the sustain electrodes is maintained at the ground level voltage is 100 μs to 1 ms.

Figure 4A:
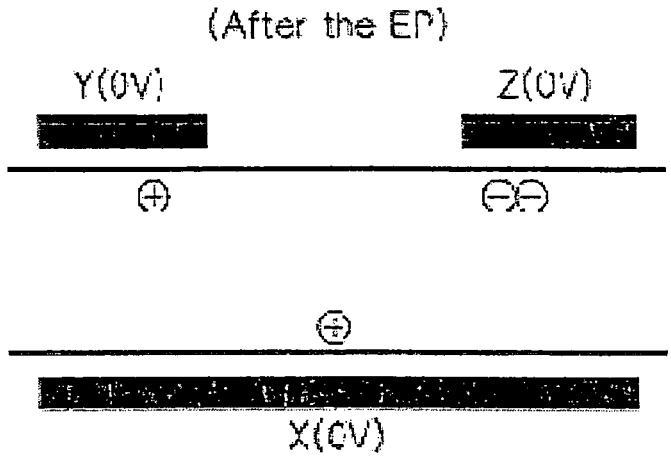
FIGS. 4*a* to 4*e* show the wall charge distribution within a discharge cell, step by step, which are changed by the driving waveform as shown in FIG. 3.
Figure 4B:
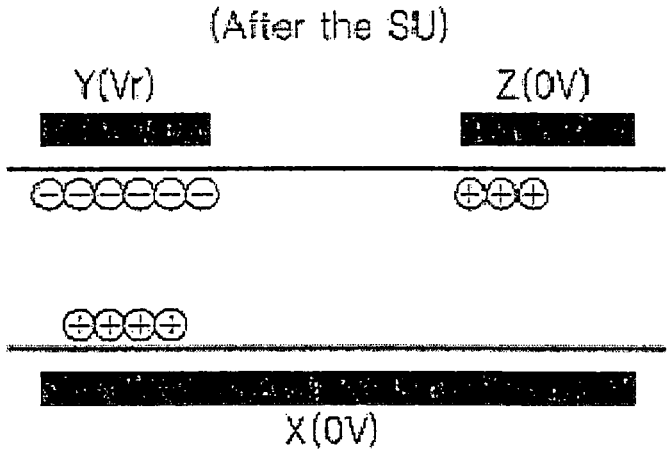
Figure 4C:
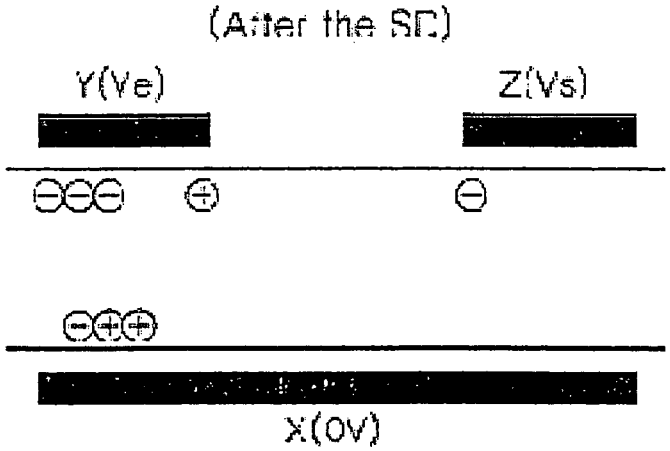
Figure 4D:
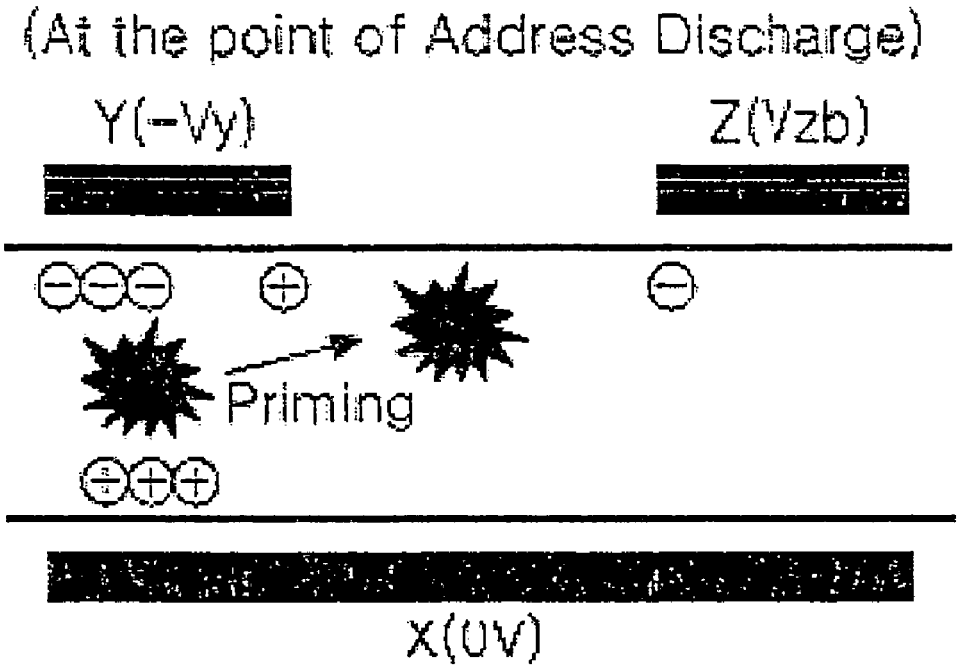
Figure 4E:
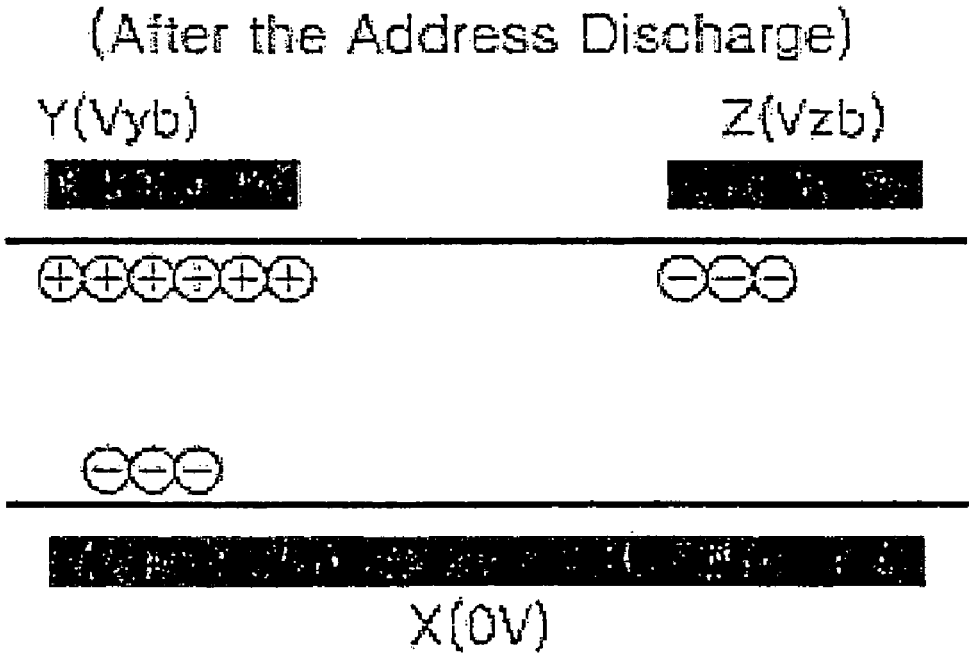
Figure 5:
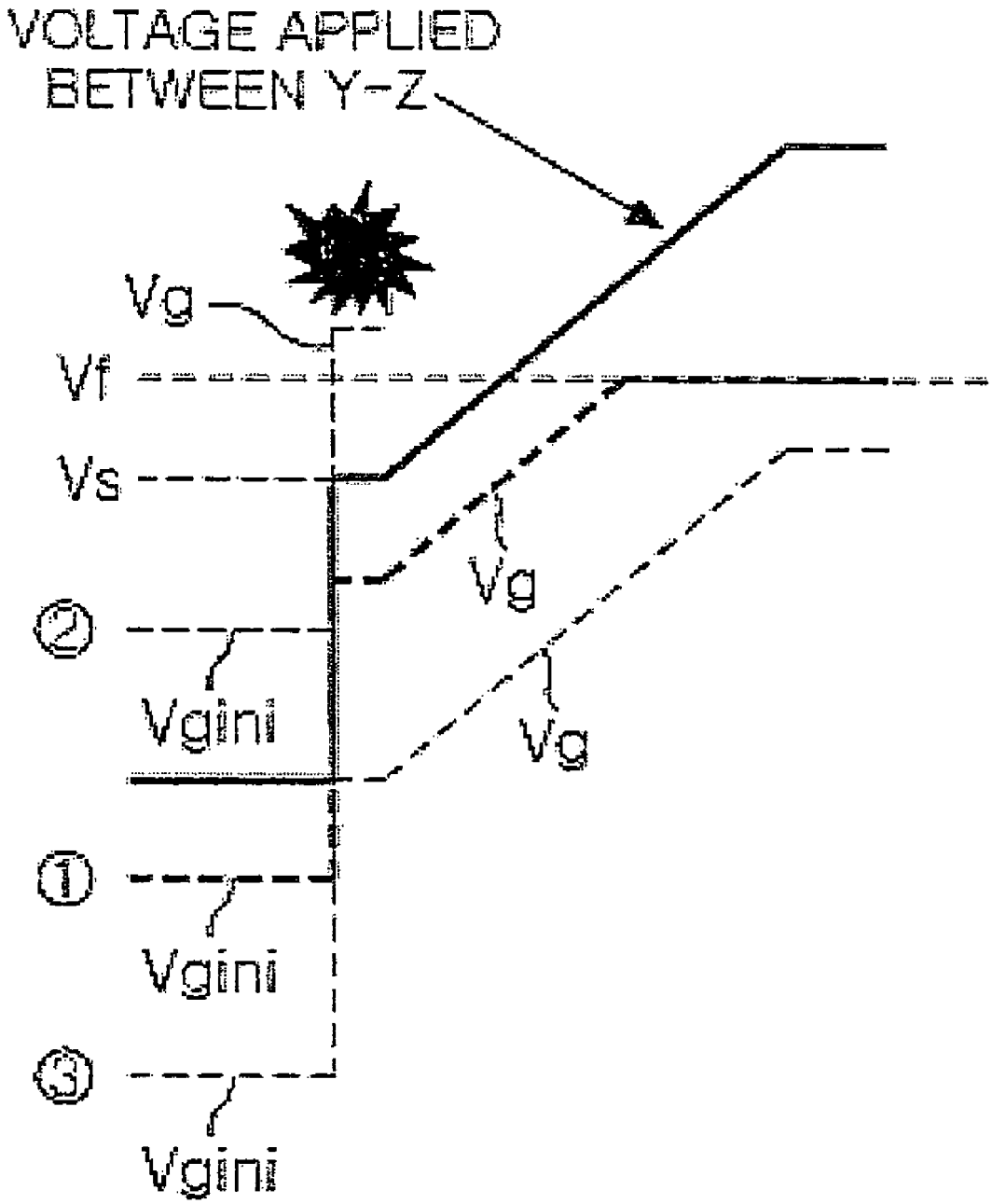
FIG. 5 shows variation in an externally applied voltage between scan electrodes and sustain electrodes and a gap voltage within a discharge cell, in a set-up period when a PDP is driven by the driving waveform as shown in FIG. 3.
Figure 6A:
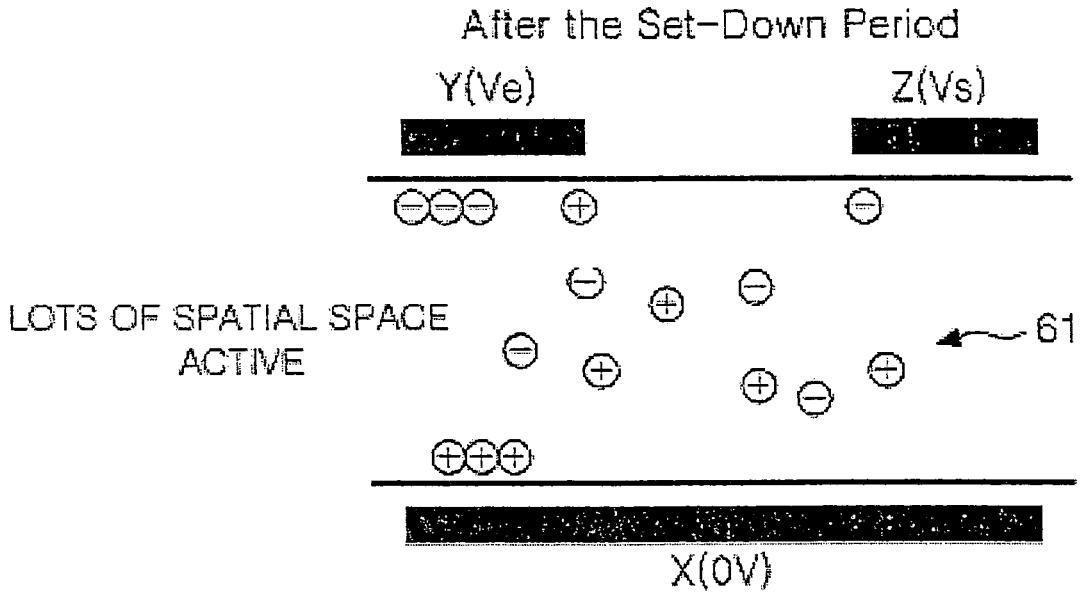
FIGS. 6*a* to 6*c* show spatial charges and the behavior of the spatial charges when a PDP is driven by the driving waveform as shown in FIG. 3 under a high temperature environment.
Figure 6B:
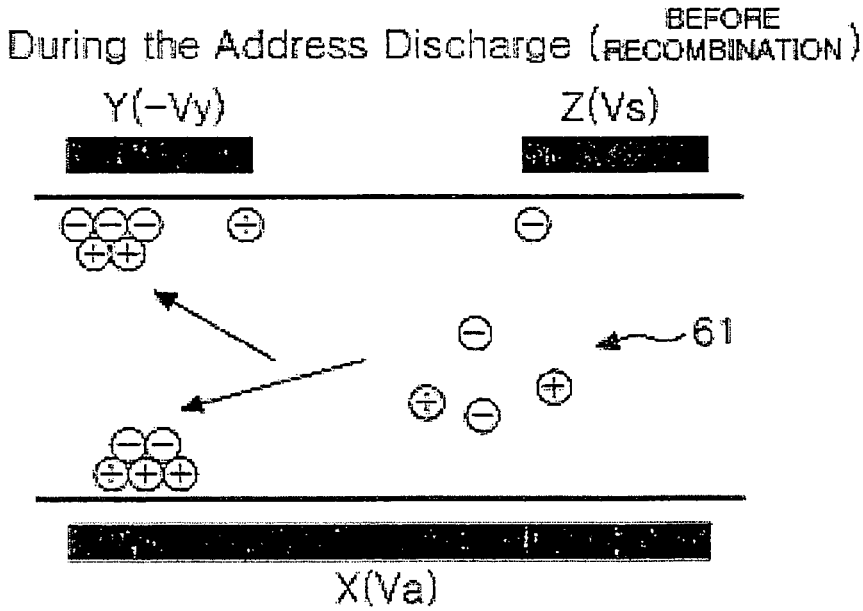
Figure 6C:
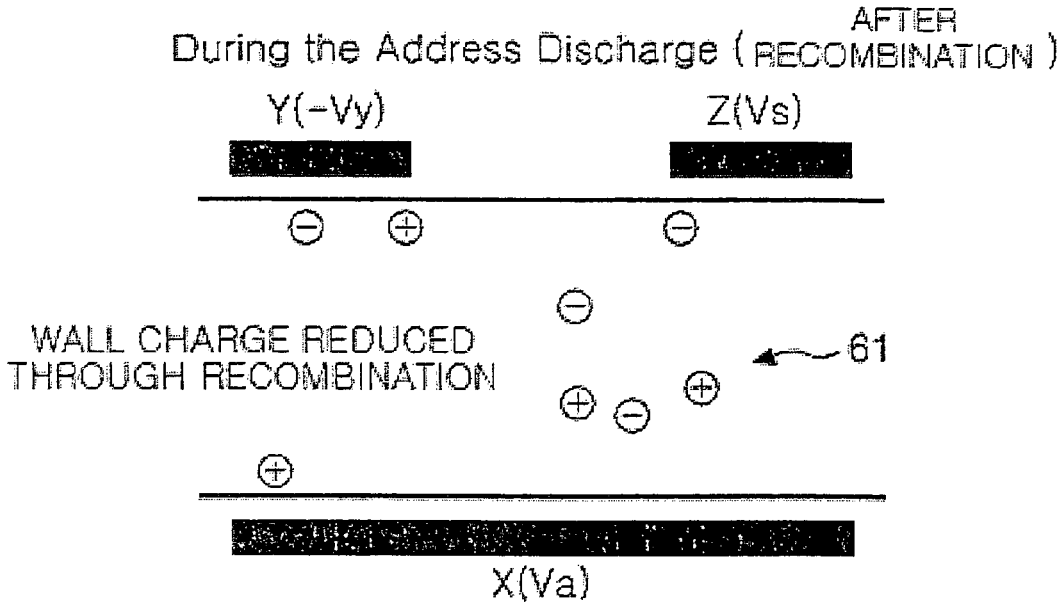

During the spatial charge decay period (Tdecay), spatial charges generated in the sustain discharge of the $(n-1)^{th}$ sub-field (SFn−1) are decayed through recombination with one another and recombination with the wall charges. After the decay of the spatial charges, a set-up discharge and a set-down discharge are continuously generated during the reset period (RP) of the $n^{th}$ sub-field (SFn). As a result, each of the discharge cells is initialized to an optimal wall charge distribution condition for an address discharge almost without the spatial charges immediately after the reset period (RP) of the $n^{th}$ (SFn) as shown in FIG. 4C.

During the erase period (EP) within the spatial charge decay period (Tdecay), an erase ramp waveform (ERR) for inducing an erase discharge is applied to the sustain electrodes Z. The erase ramp waveform (ERR) is a positive ramp waveform, which gradually rises from 0V to a positive sustain voltage (Vs). An erase discharge is generated between the scan electrodes Y and the sustain electrodes Z within on-cells in which the sustain discharge is generated by the erase ramp waveform (ERR).

Figure 8:
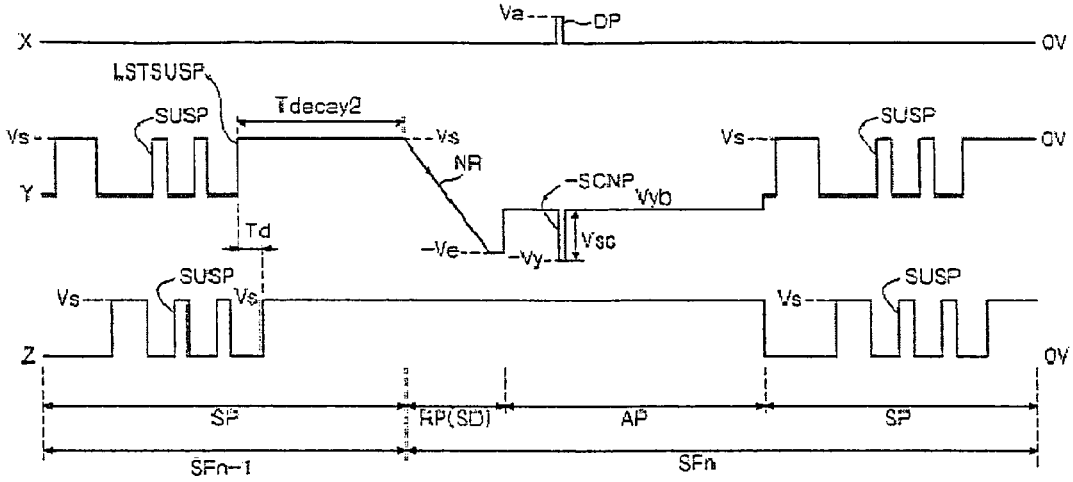
FIG. 8 shows a waveform illustrating a driving waveform of a first sub-field period in a driving method of a plasma display apparatus according to a second embodiment of the present invention.

FIG. 8 shows a waveform illustrating a driving waveform of a first sub-field period in a driving method of a plasma display apparatus according to a second embodiment of the present invention.

The driving waveform of FIG. 8 are applied to a PDP in which discharge cells are initialized only by a last sustain discharge of a previous sub-field and a subsequent set-down discharge of a next sub-field without a set-up discharge, i.e., a PDP with a high degree of uniformity and wide driving margin of discharge cells.

Referring to FIG. 8, a $(n-1)^{th}$ sub-field (SFn−1) comprises a reset period (RP), an address period (AP) and a sustain period (SP). The $n^{th}$ sub-field (SFn) comprises a reset period (RP) a set-down period. The $n^{th}$ sub-field (SFn) does not have a set-up period, an address period (AP), a sustain period (SP), and an erase period (EP).

The address period (AP) and the sustain period (SP) are substantially the same as those of the driving waveform of FIG. 3 and the embodiment of FIG. 7. Description thereof will be omitted.

In the driving method for the plasma display apparatus according to a second embodiment of the present invention, a spatial charge decay period (Tdecay2) for inducing the decay of spatial charges under a high-temperature environment is set to occur between a rising point of a last sustain pulse (LSTSUSP2) of the $(n-1)^{th}$ sub-field (SFn−1) and a falling point of a negative ramp waveform (PR) where the reset period (RP) of the $n_{th}$ sub-field (SFn) begins.

The time length of the spatial charge decay period (Tdecay2) is the same as a pulse width of the last sustain pulse, and is set to be longer under a high-temperature environment of 40° C. or higher than under a room-temperature environment. The spatial charge decay period (Tdecay2) is approximately 100 μs to 1 ms at a high temperature.

During the spatial charge decay period (Tdecay2), a last sustain pulse (LSTSUSP) of the sustain voltage (Vs) is applied to scan electrodes Y and the sustain voltage (Vs) and the sustain pulse is sustained. Subsequent to a predetermined time (Td) after the application of the last sustain pulse (LSTSUSP) is applied to the scan electrodes Y, the sustain voltage (Vs) to the sustain electrodes Z. The voltage causes negative spatial charges to be accumulated on the scan electrodes Y and positive spatial charges to be accumulated on the address electrodes X during the spatial charge decay period (Tdecay2). Therefore, immediately after the spatial charge decay period (Tdecay2), each of the discharge cells is initialized as a wall charge distribution similar to a prior set-up discharge result, i.e., a wall charge distribution similar to that of FIG. 4B, in which most of the spatial charges are dissipated at each of the discharge cells.

Subsequent to the spatial charge decay period (Tdecay2), a negative ramp waveform (NR) is applied to the scan electrodes Y in the reset period (RP(SD)) of the $n^{th}$ sub-field (SFn). During the reset period (RP(SD)), a positive sustain voltage (Vs) is applied to the sustain electrodes Z and 0V is applied to the address electrodes X. The negative ramp waveform (NR) causes a voltage of the scan electrodes Y to gradually drop from the positive sustain voltage (Vs) to a negative erase voltage (Ve). The negative ramp waveform (NR) causes a dark discharge to be generated between the scan electrodes Y and the address electrodes X within the discharge cells of the entire screen and also causes a dark discharge to be generated between the scan electrodes Y and the sustain electrodes Z. As a result of the dark discharge of the set-down period (SD), the wall charge distribution within each of the discharge cells 1 is changed to have an optimal address condition as shown in FIG. 4C.

Figure 9:
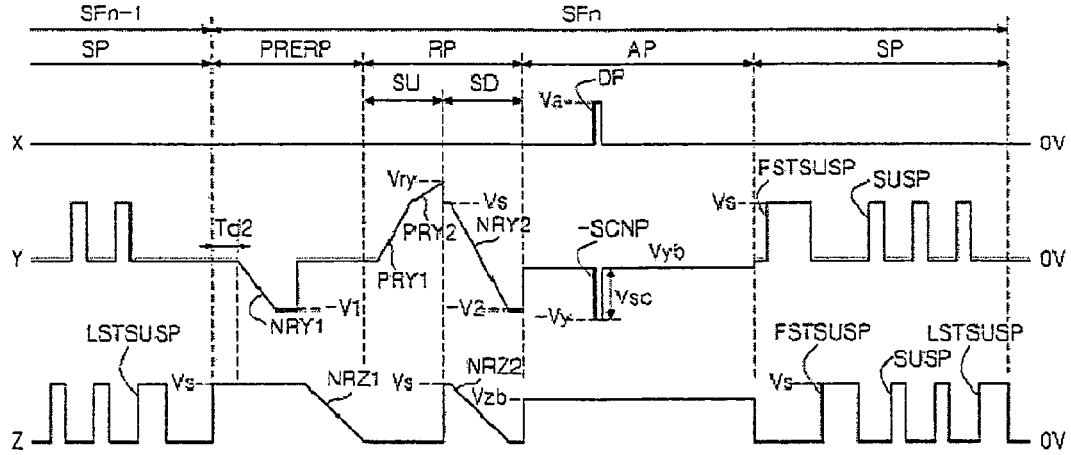
FIG. 9 shows a waveform illustrating a driving waveform of a first sub-field period in a driving method of a plasma display apparatus according to a third embodiment of the present invention.

FIG. 9 shows a waveform illustrating a driving waveform of a first sub-field period in a driving method of a plasma display apparatus according to a third embodiment of the present invention. The driving waveform of FIG. 9 will be described below in conjunction with wall charge distributions of FIGS. 10*a* to 10*e*.

Referring to FIG. 9, in the driving method of the plasma display apparatus according to the present invention, under a high temperature environment, at least one sub-field, such as a first sub-field, is driven with it being time-driven into a pre-reset period (PRERP) for forming positive wall charges on the scan electrodes Y and negative wall charges on the sustain electrodes Z, a reset period (RP) for initializing discharge cells of the entire screen using a wall charge distribution formed by the pre-reset period (PRERP), an address period (AP), and a sustain period (SP) for sustaining a discharge of selected discharge cells. An erase period may be further comprised between the sustain period (SP) and a reset period of a next sub-field.

The pre-reset period is comprised in at least one sub-field of a plurality of sub-fields. The pre-reset period can be comprised in a sub-field having the lowest gray level weight, of the plurality of sub-fields. A pre-reset waveform is supplied to the scan electrodes or the sustain electrodes prior to the reset period.

In the pre-reset waveform, after the positive sustain voltage (Vs) is applied to the entire sustain electrodes Z, a first Y negative ramp waveform (NRY1) whose voltage falls from 0V or a base voltage (GND) to a negative −V1 voltage is applied to all of the scan electrodes Y after a predetermined time (Td2) elapses. The predetermined time (Td2) can be varied depending on a panel characteristic. While a voltage of the sustain electrodes Z is sustained, the voltage of the scan electrodes Y decreases and is then maintained at the −V1 voltage for a predetermined time. During the pre-reset period (PRERP), 0V is applied to the address electrodes X.

During an initial predetermined time (Td2) of the pre-reset period (PRERP), negative spatial charges within the discharge cell are accumulated on the scan electrodes Y and then changed to wall charges, due to a difference between the sustain voltage (Vs) applied to the sustain electrodes Z and the 0V applied to the scan electrodes Y.

Positive spatial charges within the discharge cell are accumulated on the sustain electrodes Z and then changed to wall charges. After the spatial charges are erased, the sustain voltage (Vs) applied to the sustain electrodes Z and the first Y negative ramp waveform (NRY1) applied to the scan electrodes Y generate a dark discharge between the scan electrodes Y and the sustain electrodes Z and between the sustain electrodes Z and the address electrodes X for all of the discharge cells.

Figure 10A:
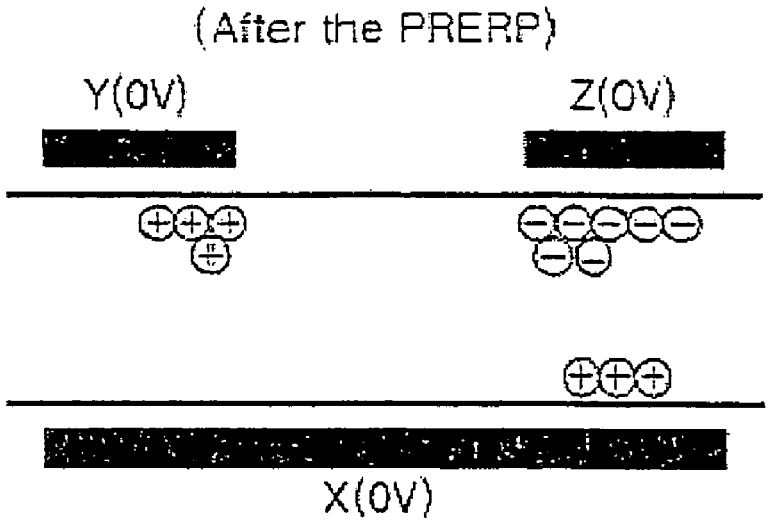
FIGS. 10*a* to 10*e* illustrate step by step, a wall charge distribution within a discharge cell, which are varied by the driving waveform as shown in FIG. 9.

As a result of the discharge, immediately after the pre-reset period (PRERP), positive wall charges are accumulated on the scan electrodes Y and negative wall charges are accumulated on the sustain electrodes Z within all of the discharge cells, as shown in FIG. 10*a*. The wall charge distribution of FIG. 10*a* causes a sufficiently high positive gap voltage to be formed between the scan electrodes Y and the sustain electrodes Z within all of the discharge cells and an electric field to be formed in a direction from the scan electrodes Y to the sustain electrode Z within each of the discharge cells.

In a set-up period (SU) of the reset period (RP), a first Y positive ramp waveform (PRY1) and a second Y positive ramp waveform (PRY2) are continuously applied to all of the scan electrodes Y, and 0V is applied to the sustain electrodes Z and the address electrodes X. A voltage of the first Y positive ramp waveform (PRY1) rises from 0V to the positive sustain voltage (Vs) and a voltage of the second Y positive ramp waveform (PRY2) rises from the positive sustain voltage (Vs) to a positive Y reset voltage (Vry) higher than the positive sustain voltage (Vs). A slope of the second Y positive ramp waveform (PRY2) is less than the slope of the first Y positive ramp waveform (PRY1).

The first Y positive ramp waveform (PRY1) and the second Y positive ramp waveform can be set to have the same slope depending on a panel characteristic. As the first Y positive ramp waveform (PRYL) and a voltage of an electric field formed between the scan electrodes Y and the sustain electrodes Z within a discharge cell are added, a dark discharge is generated between the scan electrodes Y and the sustain electrodes Z and between the scan electrodes Y and the address electrodes X within all of the discharge cells.

Figure 10B:
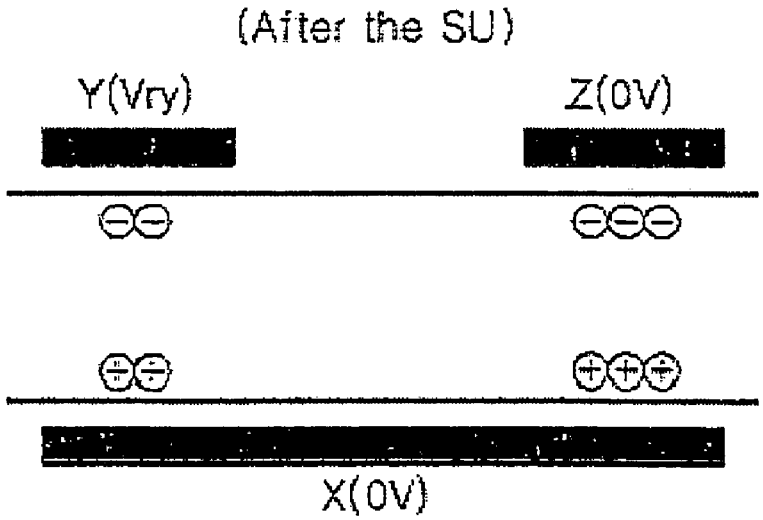

As a result of the discharge, while negative wall charges are accumulated on the scan electrodes Y within all of the discharge cells immediately after the set-up period (SU), as shown in FIG. 10*b*, the wall charges are negatively inverted in polarity. Therefore, more positive wall charges than negative wall charges are accumulated on the address electrodes X. While the negative wall charges that have been accumulated on the sustain electrodes Z are shifted toward the scan electrodes Y, they maintain a negative polarity although partially decreasing in amount.

Before the dark discharge is generated in the set-down period (SU) by the wall charge distribution immediately after the pre-reset period (PRERP), a Y reset voltage (Vr) is less than the prior reset voltage (Vr) of FIG. 3 since the positive gap voltage within the entire discharge cells is sufficiently high. As positive wall charges are sufficiently accumulated on the address electrodes X through the pre-reset period (PRERP) and the set-up period (SU), an absolute value of an external applied voltage necessary for an address discharge, i.e., an absolute values of a data voltage (Va) and a scan voltage (−Vy) decrease.

In the set-down period (SD) of the reset period (RP) subsequent to the set-up period (SU), while a second Y negative ramp waveform (NRY2) is applied to the scan electrodes Y, a second Z negative ramp waveform (NRZ2) is applied to the sustain electrodes Z. A voltage of the second Y negative ramp waveform (NRY2) drops from the positive sustain voltage (Vs) to a negative voltage (−V2). A voltage of the second Z negative ramp waveform (NRZ2) falls from the positive sustain voltage (Vs) to 0V or a base voltage. The voltage (−V2) can be the same as or different from the voltage (−V1) of the pre-reset period (PRERP).

During the set-down period (SD), the voltages of the scan electrodes Y and the sustain electrodes Z fall at the same time. Therefore, a discharge is not generated between the scan electrodes Y and the sustain electrodes Z, whereas a dark discharge is generated between the scan electrodes Y and the address electrodes X. The dark discharge causes excessive negative wall charges, which have been accumulated on the scan electrodes Y, to be erased and excessive positive wall charges, which have been accumulated on the address electrodes X, to be erased.

Figure 10C:
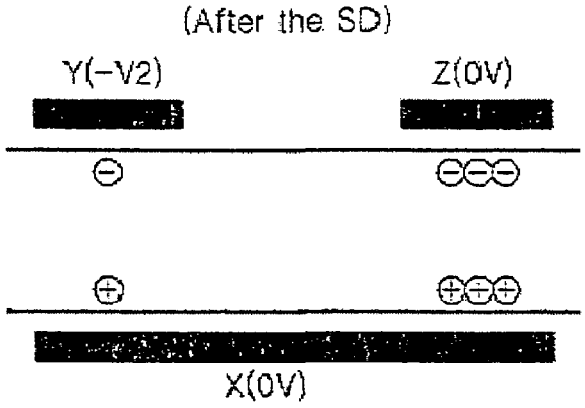

As a result of the discharge, all of the discharge cells have a uniform wall charge distribution as shown in FIG. 10*c*. In the wall charge distribution of FIG. 10*c*, the negative wall charges are sufficiently accumulated on the scan electrodes Y and the positive wall charges are sufficiently accumulated on the address electrodes X. A gap voltage between the scan electrodes Y and the address electrodes X increases to the firing voltage (Vf). Therefore, the wall charge distribution of all of the discharge cells is changed to have an optimal address condition immediately after the set-down period (SD).

In the address period (AP), while negative scan pulses (−SCNP) are sequentially applied to the scan electrodes Y, a positive data pulse (DP) is applied to the address electrodes X in synchronization with the scan pulse (−SCNP). A voltage of the scan pulse (SCNP) is a scan voltage (Vsc), which drops from 0V or a negative scan bias voltage (Vyb) close to 0V to a negative scan voltage (−Vy). during the address period (AP), a positive Z bias voltage (Vzb) less than the positive sustain voltage (Vs) is applied to the sustain electrodes Z.

Figure 10D:
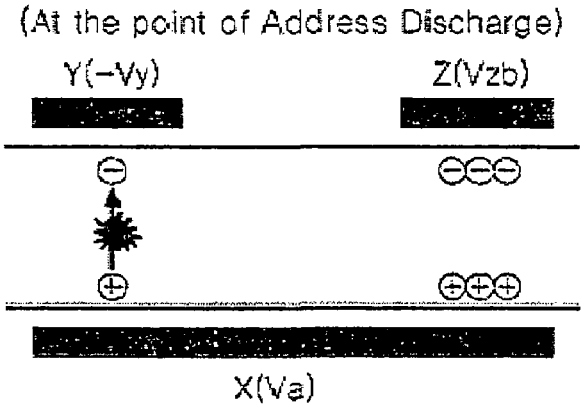
Figure 10E:
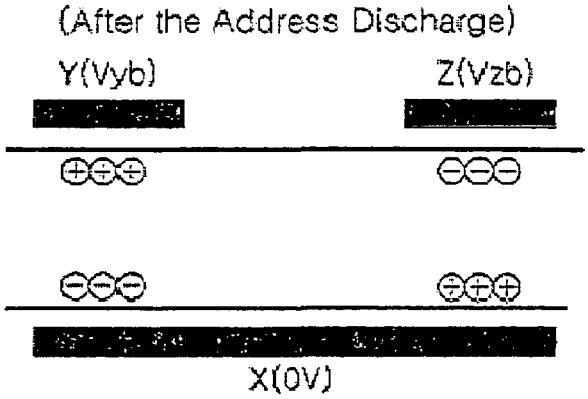

When the gap voltage of all of the discharge cells is adjusted to an optimal address condition immediately after the reset period (RP), a gap voltage between the scan electrodes Y and the address electrodes X exceeds the firing voltage (Vf) within on-cells to which the scan voltage (Vsc) and the data voltage (Va) are applied. Therefore, an address discharge is generated only between the electrodes Y and X. The wall charge distribution within the on-cells where the address discharge is generated is shown in FIG. 10*d*. Immediately after the address discharge, the wall charge distribution of the on-cells is changed to that shown in FIG. 10E as positive wall charges are accumulated on the scan electrodes Y and negative wall charges are accumulated on the address electrodes X by the address discharge.

Off-cells in which 0V or a base voltage is applied to the address electrodes X or 0V or the scan bias voltage (Vyb) is applied to the scan electrodes Y have a gap voltage less than the firing voltage. Therefore, off-cells in which an address discharge is not generated have a wall charge distribution, which is substantially the same as that shown in FIG. 10*c*.

In the sustain period (SP), sustain pulses (FISRTSUSP, SUSP and LSTSUSP) of the positive sustain voltage (Vs) are alternately applied to the scan electrodes Y and the sustain electrodes Z. During the sustain period (SP), 0V or a base voltage is applied to the address electrodes X. A pulse width of the sustain pulse (FSTSUSP), which is firstly applied to each of the scan electrodes Y and the sustain electrodes Z, is set to be wider than the width of a normal sustain pulse (SUSP) to stabilize sustain discharge initiation. The last sustain pulse (LSTSUSP) is applied to the sustain electrodes Z.

At an initial state of the set-up period (SU), a pulse width of the last sustain pulse (LSTSUSP) is set to be wider than the width of the normal sustain pulse (SUSP) to sufficiently accumulate negative wall charges on the sustain electrodes Z. During the sustain period, on-cells selected by an address discharge generate a sustain discharge between the scan electrodes Y and the sustain electrodes Z every sustain pulse (SUSP) resulting from the wall charge distribution of FIG.

10*e*. An initial wall charge distribution of the sustain period (SP) in off-cells is the same as that of FIG. 10*c*. Although the sustain pulses (FIRSTSUSP, SUSP and LSTSUSP) are applied to the off-cells, the gap voltage of the sustain pulses is maintained at less than the firing voltage (Vf), so that a discharge is not generated in the off-cells.

To reduce an amount of spatial charges generated in the sustain discharge, a rising period and a falling period of each of the sustain pulses (FIRSTSUSP, SUSP and LSTSUSP) is set to be relatively long, from 320 ns to 360 ns.

The driving waveform of FIG. 9 is not limited only to the first sub-field, but can be applied to several initial sub-fields including a first sub-field and can also be applied to all of the sub-fields comprised in one frame period.

Figure 2:
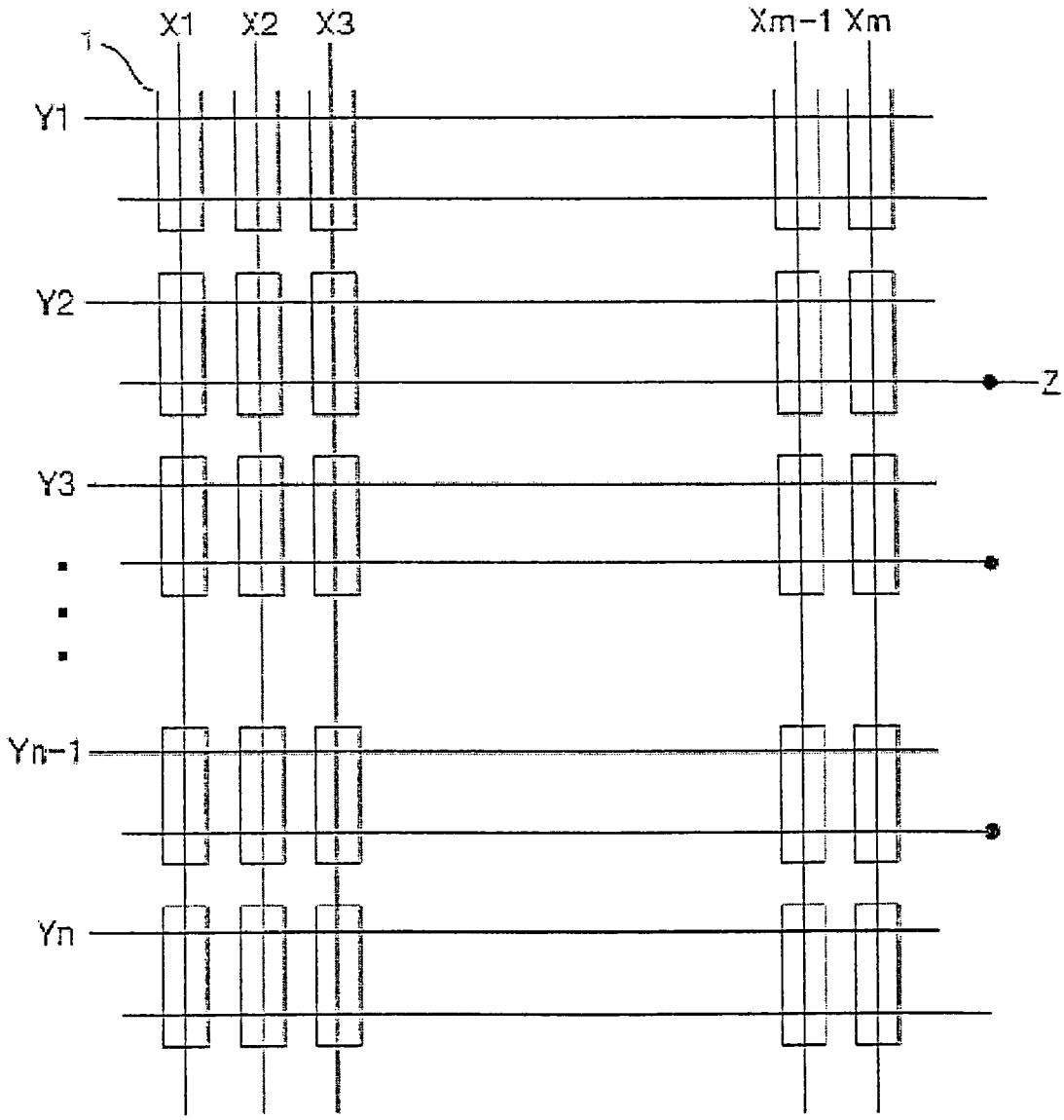
FIG. 2 is a plan view schematically showing the arrangements of electrodes of a three-electrode AC surface discharge type PDP.
Figure 11:
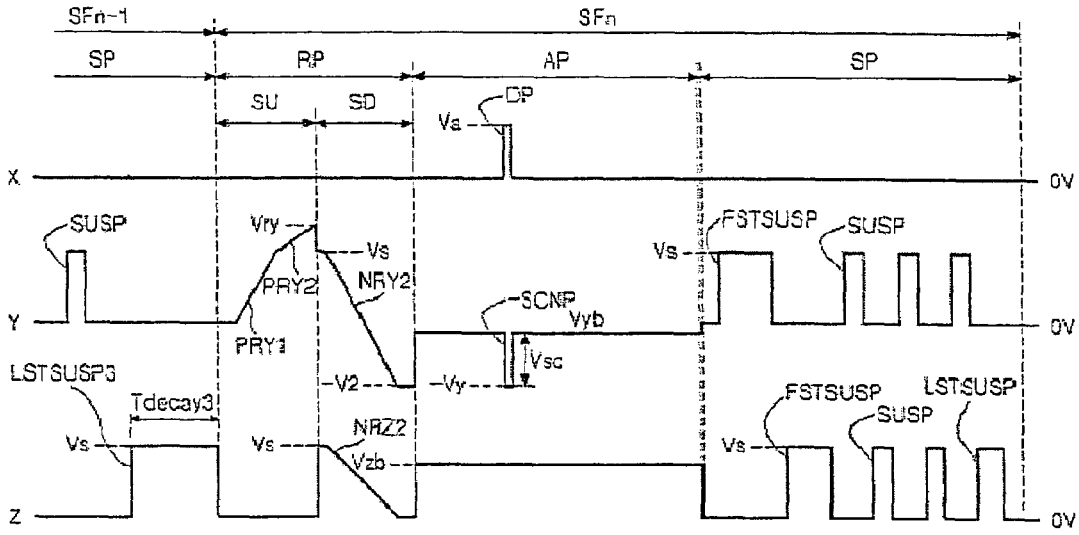
FIG. 11 is a waveform showing a driving waveform of the remaining sub-field periods other than the first sub-field period in the driving method of the plasma display apparatus according to a third embodiment of the present invention.

FIG. 11 shows a driving waveform supplied to a PDP as shown in FIG. 2 during a sustain period (SP) of a $(n-1)^{th}$ (where n is a positive integer greater than 2) sub-field (SFn−1) and a $n^{th}$ sub-field (SFn) in a driving method of a plasma display apparatus according to a third embodiment of the present invention. The driving waveform of FIG. 11 will be described in conjunction with the wall charge distribution of FIGS. 12 and 13.

Referring to FIG. 11, in the $n^{th}$ sub-field (SFn), all of the cells of the PDP are initialized using a wall charge distribution formed immediately after the sustain period in the $(n-1)^{th}$ sub-field (SFn−1), e.g., the first sub-field.

Each of the $(n-1)^{th}$ sub-field (SFn−1) and the $n^{th}$ sub-field (SFn) comprises a reset period (RP) for initializing the whole cells resulting from a wall charge distribution in which negative wall charges are sufficiently accumulated on the sustain electrodes Z, an address period (AP) for selecting cells and a sustain period (SP) for sustaining the discharge of selected cells.

In a sustain period of the $(n-1)^{th}$ sub-field (SFn−1), a last sustain pulse (LSTSUSP3) is applied to the sustain electrodes Z. 0V or a base voltage is applied to the scan electrodes Y and the address electrodes X. A spatial charge decay period (Tdecay3) corresponding to a pulse width of the last sustain pulse (LSTSUSP3) is set to allow enough time for the spatial charges to change into wall charges, thus inducing a sustain discharge within on-cells and also erasing spatial charges within the discharge cells prior to the reset period (RP) of the $n^{th}$ sub-field (SFn). The spatial charge decay period (Tdecay3) in which the last sustain pulse (LSTSUSP3) is maintained at a sustain voltage (Vs) is approximately 300 μs±50 μs.

Figure 12:
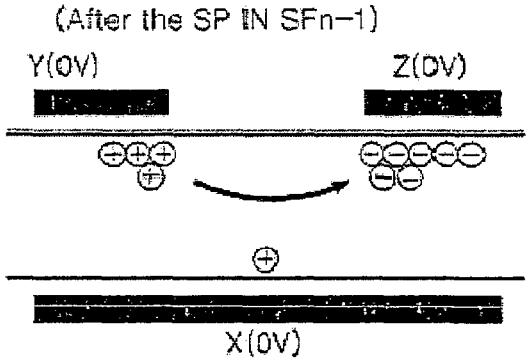
FIG. 12 shows the distribution of wall charges formed within a discharge cell immediately after a sustain period by the driving waveform shown in FIG. 11.

Positive wall charges are sufficiently accumulated on the scan electrodes Y and negative wall charges are accumulated on the sustain electrodes Z almost without spatial charges as shown in FIG. 12 due to the discharge generated between the scan electrodes Y and the sustain electrodes Z by the last sustain pulse (LSTSUSP3).

In a set-up period (SU) of the $n^{th}$ sub-field (SFn), the wall charge distribution of FIG. 12 is used to generate a dark discharge in the whole cells, thus initializing the whole cells with the wall charge distribution as shown in FIG. 10*b*. A set-up period (SU), and a set-down initialization, address and sustain operations thereafter are substantially the same as those of the driving waveform of FIG. 9.

In the plasma display apparatus and driving method thereof according to a third embodiment of the present invention, spatial charges are changed to wall charges under a high-temperature environment to stably initialize a wall charge distribution under a high-temperature environment. A set-up period of a next sub-field immediately follows a last sustain discharge of a previous sub-field, without an erase period for erasing wall charges between a sustain period of a previous sub-field and a reset period of a next sub-field. Since a sustain discharge is a strong glow discharge, it can sufficiently accumulate lots of wall charges on the scan electrodes Y and the sustain electrodes Z and can stably sustain the polarities of positive wall charges on the scan electrodes Y and negative wall charges on the sustain electrodes Z.

Figure 13:
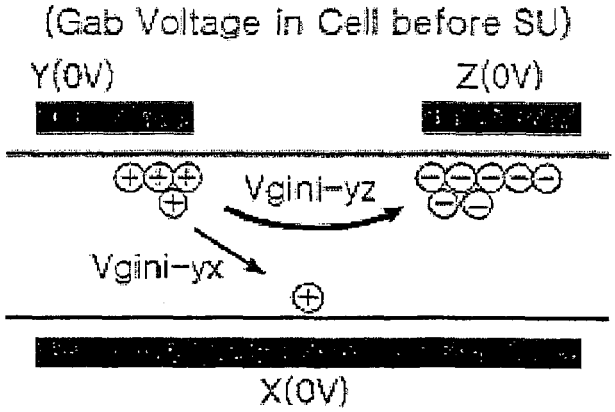
FIG. 13 shows the distribution of wall charges within a discharge cell, which are formed before a set-up period by the driving waveform of FIGS. 9 and 11, and a gap voltage.

FIG. 13 shows a cell gap voltage state of a cell, which is formed by a last sustain discharge or the discharge of the pre-reset period (PRERP).

Referring to FIG. 13, a discharge is generated between the scan electrodes Y and the sustain electrode Z by means of the last sustain pulse (LSTSUSP) or the waveforms (NRY1, PRZ and NRZ1) of the pre-reset period (PRERP). Immediately before the set-up period (SU), an inter-Y-Z initial gap voltage (Vgini-yz) is formed within a cell by an electric field directed from the scan electrodes Y to the sustain electrodes Z. An inter-Y-X initial gap voltage (Vgini-yx) is formed within the cell by an electric field directed from the scan electrodes Y to the address electrodes X.

The inter-Y-Z initial gap voltage (Vgini-yz) has already been formed in the discharge cell by the wall charge distribution of FIG. 13 before the set-up period (SU). If an external voltage is applied equal to the between the firing voltage (Vf) and the inter-Y-Z initial gap voltage (Vgini-yz), a dark discharge is generated in the discharge cell during the set-up period (SU). This can be expressed in the following Equation 5.

$$Vyz = Vf - (Vgini\text{-}yz) \tag{5}$$

Vyz is an external voltage (hereinafter, referred to as "inter-Y-Z external voltage") applied to the scan electrodes Y and the sustain electrodes Z during the set-up period (SU). The voltage Vyz indicates a voltage of the positive ramp waveforms (PRY1, PRY2) applied to the scan electrodes and 0V applied to sustain electrodes Z, in the driving waveforms of FIGS. 9 and 11.

Figure 14:
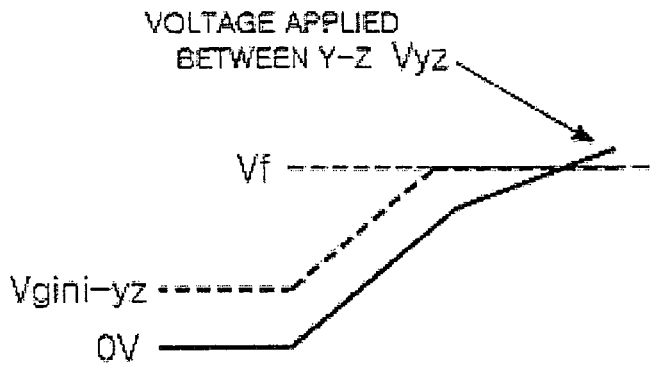
FIG. 14 shows variation in an externally applied voltage between scan electrodes and sustain electrodes and a gap voltage within a discharge cell, in a set-up period when a PDP is driven by the driving waveform as shown in FIGS. 9 and 11.

As shown in Equation 5 and FIG. 14, if the inter-Y-Z external voltage (Vyz) is higher than a difference between the firing voltage (Vf) and the inter-Y-Z initial gap voltage (Vgini-yz) during the set-up period (SU), a dark discharge can be stably generated in the discharge cells due to a wide driving margin.

In the plasma display apparatus according to a third embodiment of the present invention, an amount of light emission generated during the reset period every sub-field is minimal in comparison to the related art. This is because the number of discharges, which are generated in a cell during the reset period of each sub-field, more particularly, the number of surface discharges, are less than that of the related art.

Table 2 below shows the type and number of discharges, which are generated in the pre-reset period (PRERP) and the reset period (RP) of the first sub-field, which have been described with reference to the driving waveform view of FIG. 9. Table 3 shows the type and number of discharges, which are generated in the reset period (RP) of each of the remaining sub-fields without the pre-reset period (PRERP), which has been described with reference to the driving waveform view of FIG. 11.

TABLE 2

| Cell State | Operating Time | | |
|---|---|---|---|
| | | RP | |
| | PRERP | SU | SD |
| Counter discharge (Y-X) | ○ | ○ | ○ |
| Surface discharge (Y-Z or Z-X) | ○ | ○ | X |

TABLE 3

| Cell State | | Operating Time RP of SFn | |
|---|---|---|---|
| | | SU | SD |
| On-cell turned on at SFn − 1 | Counter discharge (Y-X) | ○ | X |
| | Surface discharge (Y-Z) | ○ | ○ |
| Off-cell turned off at SFn − 1 | Counter discharge (Y-X) | X | ○ |
| | Surface discharge (Y-Z) | X | X |

As shown in Table 2, in the driving waveform of the first sub-field of FIG. 9, three counter discharges and two surface discharges are generated by maximum through the pre-reset period (PRERP) and the reset period (RP). In the remaining sub-fields subsequent to the first sub-field, one counter discharge and two surface discharge by maximum are generated during the reset period (RP), and only one counter discharge is generated in an off-cell, as shown in the Table 3.

In the plasma display apparatus according to a third embodiment of the present invention, however, in the case where the apparatus is driven with one frame period being divided into twelve sub-fields, a luminance of a black screen decreases to one third or less compared with the prior art plasma display apparatus, due a difference in the number of discharges and the types of discharge. Therefore, the plasma display apparatus according to the present invention can display a black screen with a low darkroom contrast value compared with the prior art and can display an image with a higher definition.

Figure 15:
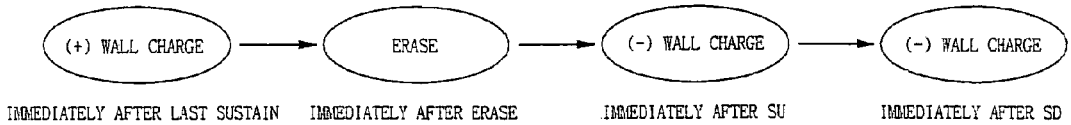
FIG. 15 illustrates a variation in the polarity of wall charges on sustain electrodes, which is incurred by the conventional driving waveform as shown in FIG. 3, during an erase period and a reset period.

A small number of discharges in the reset period (RP) means that a change in wall charges or variations in the polarity is low within discharge cells. For example, in the conventional plasma display apparatus, the polarity of wall charges on the sustain electrodes Z is changed from a positive polarity, to an erase and negative polarity (FIG. 4*a*), to a positive polarity (FIG. 4*b*) and then a negative polarity (FIG. 4*c*) from immediately after the last sustain discharge of the $(n-1)^{th}$ sub-field (SFn−1) to immediately after the dark discharge of the set-down period (SD) of the $n^{th}$ sub-field (SFn), as shown in FIG. 15.

Figure 16:
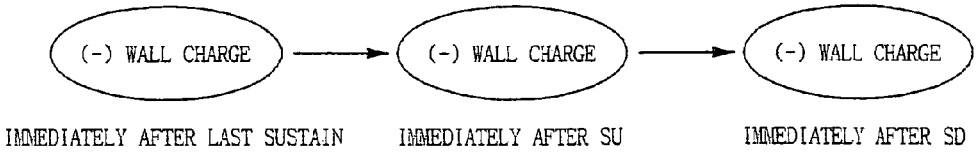
FIG. 16 illustrates a variation in the polarity of wall charges on sustain electrodes, which is incurred by the driving waveform as shown in FIGS. 9 and 11, during a reset period.

In the plasma display apparatus of the present invention, however the polarity of wall charges on the sustain electrodes Z is maintained at a negative polarity from immediately after the last sustain discharge of the $(n-1)^{th}$ sub-field (SFn−1) to immediately after a dark discharge of the set-down period (SD) of the $n^{th}$ sub-field (SFn), as shown in FIG. 16. In other words, in the plasma display apparatus of the present invention, the address period (AP) begins while the polarity of the wall charges on the sustain electrodes X is maintained at a negative polarity in the initialization process, as shown in FIGS. 10*a*, 10*b* and 10*c*.

Figure 17:
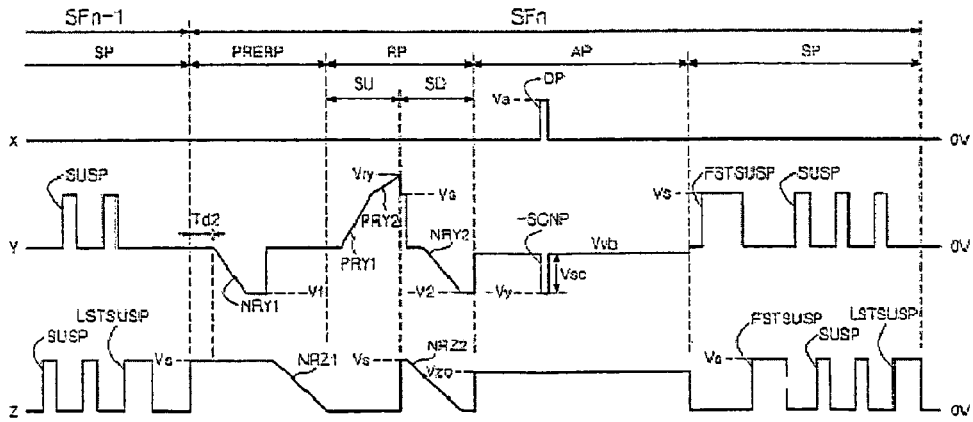
FIG. 17 shows a waveform illustrating a driving waveform of a first sub-field in a driving method of a plasma display apparatus according to a fourth embodiment of the present invention.
Figure 18:
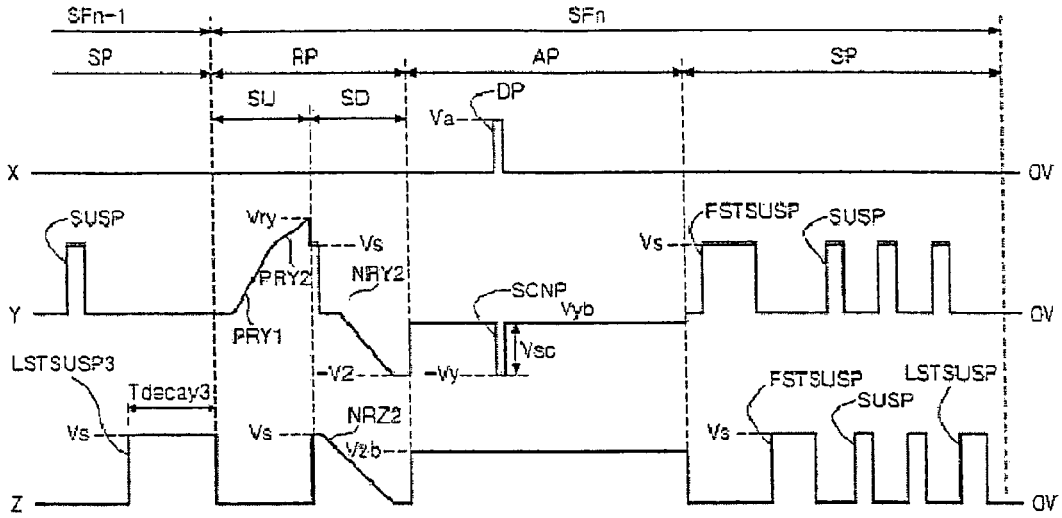
FIG. 18 shows a waveform illustrating a driving waveform of the remaining sub-field periods other than the first sub-field period in the driving method of the plasma display apparatus according to a fourth embodiment of the present invention.

FIG. 17 shows a waveform illustrating a driving waveform of a first sub-field in a driving method of a plasma display apparatus according to a fourth embodiment of the present invention. FIG. 18 shows a driving waveform during a sustain period (SP) of a $(n-1)^{th}$ (where n is a positive integer greater than 2) sub-field (SFn−1) and a $n^{th}$ sub-field (SFn) in a driving method of a plasma display apparatus according to a fourth embodiment of the present invention.

Referring to FIGS. 17 and 18, in the driving method of the plasma display apparatus according to the present invention, in each sub-field, a voltage that falls from 0V or a based voltage (GND) is applied to scan electrodes Y during a set-down period (SD), thus creating a uniform wall charge distribution in all of the discharge cells that are initialized at a set-up period (SU).

A first sub-field comprises a pre-reset period (PRERP), a reset period (RP), an address period (AP) and a sustain period (SP), as shown in FIG. 17. The remaining sub-fields (SFn) comprise a reset period (RP), an address period (AP) and a sustain period (SP), as shown in FIG. 18.

To change spatial charges into wall charges thereby erasing the spatial charges and also form a wall charge distribution as shown in FIG. 10*a* in each of the discharge cells, during the pre-reset period (PRERP) of the first sub-field, after a positive sustain voltage (Vs) is applied to the entire sustain electrodes Z, a first Y negative ramp waveform (NRY1) whose voltage falls from 0V or the base voltage (GND) to a negative voltage (−V1) is applied to all of the scan electrodes Y after a predetermined time (Td2) elapses.

A last sustain pulse (LSTSUSP3), which is applied to the sustain electrodes Z before the reset period (RP) of the $n^{th}$ sub-field other than the first sub-field, is maintained at the positive sustain voltage (Vs) during a spatial charge decay period (Tdecay3) of approximately 300 μs±50 μs. During the spatial charge decay period (Tdecay3), spatial charges are changed into wall charges and then erased.

In the set-down period (SD) of the reset period (RP) of each of the sub-fields (SFn−1, SFn), while a second Y negative ramp waveform (NRY2) is applied to the scan electrodes, a second Z negative ramp waveform (NRZ2) is applied to the sustain electrodes Z. A voltage of the second Y negative ramp waveform (NRY2) drops from 0V or a base voltage (GND) to a negative voltage (−V2) unlike the above-described embodiments. A voltage of the second Z negative ramp waveform (NRZ2) drops from a positive sustain voltage (Vs) to 0V or the base voltage.

During the set-down period (SD), the voltages of the scan electrodes Y and the sustain electrodes Z decrease simultaneously. Therefore, a discharge is not generated between the scan electrodes Y and the sustain electrodes Z, whereas a dark discharge is generated between the scan electrodes Y and the address electrodes X.

The dark discharge causes excessive negative wall charges, which have been accumulated on the scan electrodes Y, to be erased and excessive positive wall charges, which have been accumulated on the address electrodes X, to be erased. The second Z negative ramp waveform (NRZ2) is omitted.

If a voltage of the second Y negative ramp waveform (NRY2) drops from 0V or the base voltage, the set-down period (SD) will become shorter compared with the above-mentioned embodiments. Although a voltage of the second Y negative ramp waveform (NRY2) decreases from 0V or the base voltage, a voltage difference between the scan electrodes Y and the sustain electrodes Z is minimal.

The plasma display apparatus of the present invention can stabilize initialization while effectively suppressing a discharge between the scan electrodes Y and the sustain electrodes Z. Therefore, the present embodiment can secure more driving time due to the reduction of the set-down period (SD) and can stabilize an initialization operation of the set-down period (SD).

To reduce an amount of spatial charges generated in a sustain discharge, a rising period and a falling period of each of the sustain pulses (FIRSTSUSP, SUSP, LSTSUSP) is set to be relatively long, from 320 ns to 360 ns.

Figure 19:
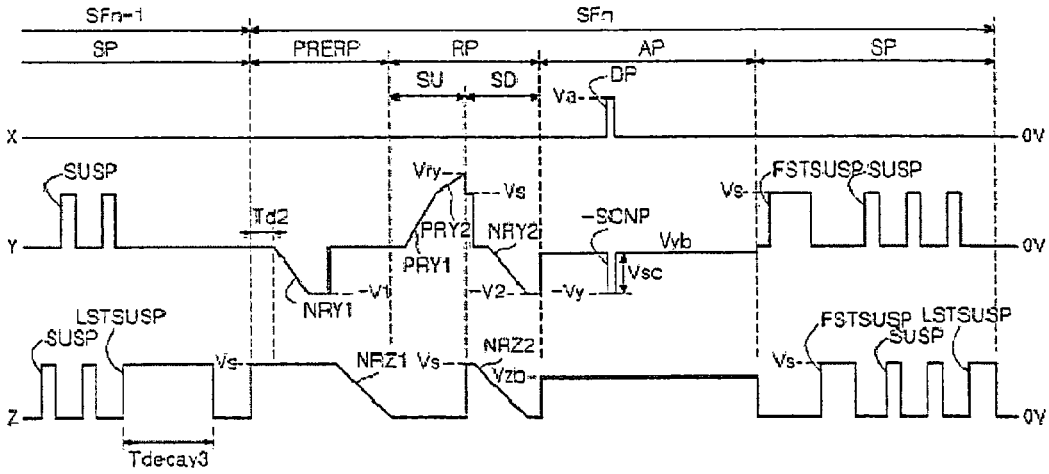
FIG. 19 shows a waveform for illustrating a driving method of driving a plasma display apparatus according to a fifth embodiment of the present invention.

FIG. 19 shows a waveform for illustrating a driving method of driving a plasma display apparatus according to a fifth embodiment of the present invention. FIG. 19 shows a waveform of a driving waveform applied to a high temperature environment.

Referring to FIG. 19, in the driving method of the plasma display apparatus according to the present invention, during the latter period of a $(n-1)^{th}$ sub-field (SFn−1), a last sustain pulse (LSTSUSP), which is maintained at a positive sustain voltage during a spatial charge decay period (Tdecay3) of approximately 300 μs to 500 μs, is applied to the sustain electrodes Z. 0V or a base voltage (GND) is then applied to the sustain electrodes Z.

In the driving method of the plasma display apparatus according to the present invention, after a positive sustain voltage (Vs) is applied to all of the sustain electrodes Z, a first Y negative ramp waveform (NRY1), which drops from 0V or the base voltage (GND) to a negative voltage (−V1), is applied to all of the scan electrodes Y after a predetermined time (Td2) elapses. Therefore, When a voltage of the sustain electrodes Z is maintained at the sustain voltage (Vs), a first Y negative ramp waveform (NRY1) is applied to the scan electrodes Y.

In the driving method of the plasma display apparatus according to the present invention, after 0V or the base voltage (GND) is applied to the scan electrodes Y, a first Z negative ramp waveform (NRZ1), which gradually decreases from the sustain voltage (Vs) to 0V or the base voltage (GND), is applied to the sustain electrodes.

To reduce an amount of spatial charges generated in a sustain discharge, a rising period and a falling period of each of sustain pulses (FIRSTSUSP, SUSP, LSTSUSP) can be set to be relatively long, from approximately 320 ns to 360 ns.

Spatial charges, which are generated under a high-temperature environment by a series of driving waveforms, are almost erased or changed to wall charges prior to the $n^{th}$ sub-field (SFn). Each of discharge cells is initialized to have a wall charge distribution as shown in FIG. 10*a*.

Figure 20:
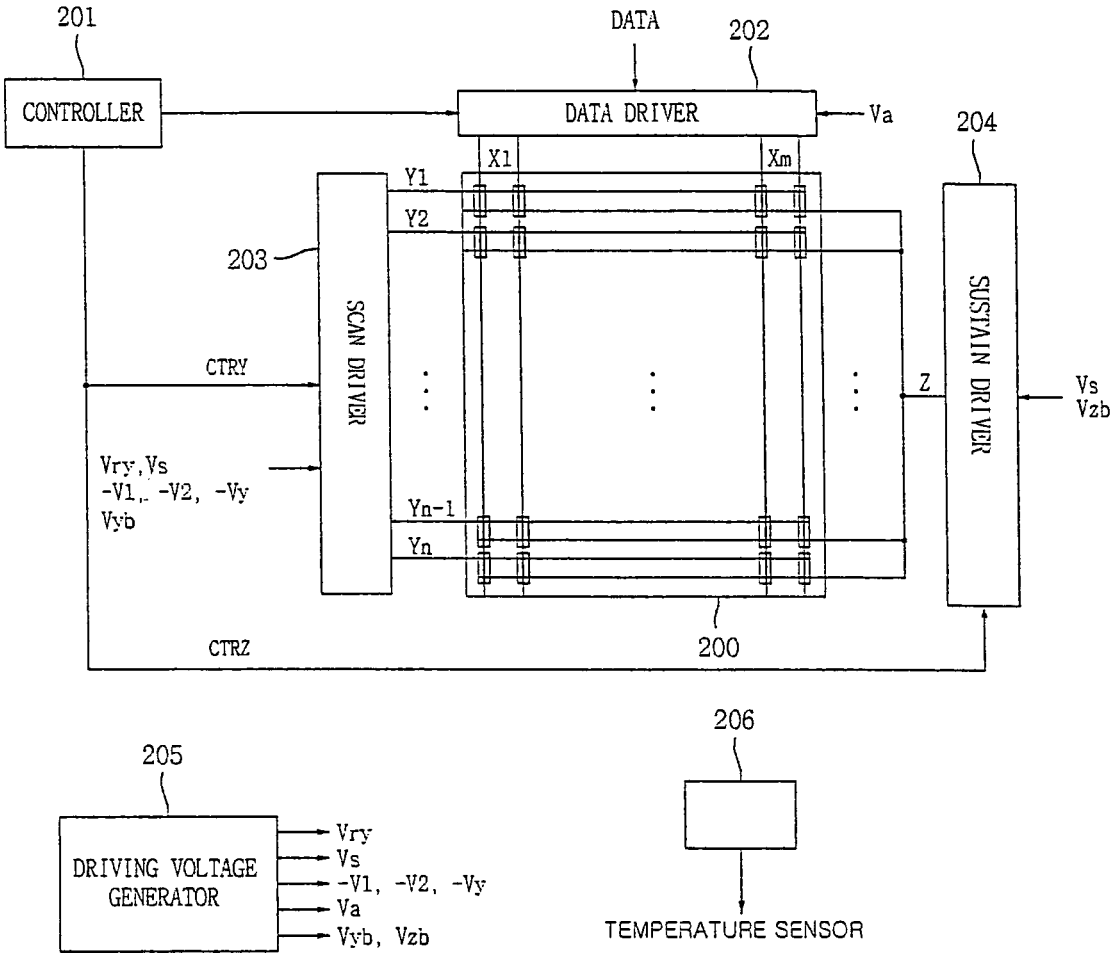
FIG. 20 is a block diagram illustrating the construction of a plasma display apparatus according to an embodiment of the present invention.

FIG. 20 is a block diagram illustrating the construction of a plasma display apparatus according to an embodiment of the present invention.

Referring to FIG. 20, the plasma display apparatus of the present invention comprises a PDP 200, a temperature sensor 206 for sensing a temperature of the PDP 200, a data driver 202 for supplying data to address electrodes X1 to Xm of the PDP 200, a scan driver 203 for driving scan electrodes Y1 to Yn of the PDP 200, a sustain driver 204 for driving sustain electrodes Z of the PDP 200, a timing controller 201 for controlling the respective drivers 202, 203 and 204 depending on a temperature of the PDP 200, and a driving voltage generator 205 for generating driving voltages necessary for the respective drivers 202, 203 and 204.

The temperature sensor 206 senses a temperature of the PDP to generate a sense voltage, converts the sense voltage into a digital signal and supplies the digital signal to the timing controller 201.

The data driver 202 is supplied with data, which undergoes an inverse gamma correction, erroneous diffusion, etc. through an inverse gamma correction circuit (not shown), an error diffusion circuit (not shown), etc., and the data is then mapped to predetermined sub-field patterns by a sub-field mapping circuit. As shown in FIGS. 7, 8, 9, 11, 17, 18 and 19, the data driver 202 applies 0V or the base voltage to the address electrodes X1 to Xm during the pre-reset period (PRERP), the reset period (RP) and the sustain period (SP). The data driver 202 samples and latches data during the address period (AP) of each of sub-fields and then supplies the data voltage (Va) to the address electrodes X1 to Xm, under the control of the timing controller 201.

As shown in FIGS. 7, 8, 9, 11, 17, 18 and 19, the scan driver 203 supplies the ramp waveforms (NRY1, PRY1, PRY2, NRY2) to the scan electrodes Y1 to Yn to initialize all of the discharge cells during the pre-reset period (PRERP) and the reset period (RP), and then sequentially supplies the scan pulses (SCNP) to the scan electrodes Y1 to Yn to select a scan line to which data are supplied during the address period (AP), under the control of the timing controller 201.

When the temperature of the PDP is high, the scan driver 203 supplies the sustain pulses (FSTSUSP, SUSP) whose rising period and falling period are approximately 340 ns±20 ns to the scan electrodes Y1 to Yn to generate a sustain discharge in selected on-cells during the sustain period (SP).

As shown in FIGS. 6, 8, 14 to 23, the sustain driver 204 supplies the ramp waveforms (NRZ1, NRZ2) to the sustain electrodes Z to initialize all of the discharge cells during the pre-reset period (PRERP) and the reset period (RP), and then supplies the Z bias voltage (Vzb) to the sustain electrodes Z during the address period (AP), under the control of the timing controller 201. The sustain driver 204 operates alternately with the scan driver 203 to supply the sustain pulses (FSTSUSP, SUSP, LSTSUSP) to the sustain electrodes Z during the sustain period (SP).

When the temperature of the PDP is high, a pulse width of the last sustain pulse (LSTSUSP) generated in the sustain driver 204 is long, 300 μs±50 μs. A rising period and a falling period of each of the sustain pulses (FSTSUSP, SUSP, LSTSUSP) is approximately 340 ns±20 ns.

The timing controller 201 receives vertical/horizontal synchronization signals and a clock signal to generate timing control signals (CTRX, CTRY, CTRZ) necessary for the respective drivers 202, 203 and 204. The timing controller 201 supplies the timing control signals (CTRX, CTRY, CTRZ) to corresponding drivers 202, 203 and 204 to control the respective drivers 202, 203 and 204.

The timing control signal (CTRX) supplied to the data driver 202 comprises a sampling clock for sampling data, a latch control signal, and a switching control signal for controlling an on/off time of an energy recovery circuit and a driving switch element. The timing control signal (CTRY) applied to the scan driver 203 comprises a switching control signal for controlling an on/off time of an energy recovery circuit and a driving switch element within the scan driver 203. The timing control signal (CTRZ) applied to the sustain driver 204 comprises a switching control signal for controlling an on/off time of an energy recovery circuit and a driving switch element within the sustain driver 204.

When the temperature of the PDP is high, the timing controller 201 receives an output voltage from the temperature sensor 206 to control the scan driver 203 and the sustain driver 204 so that a pulse width of the last sustain pulse (LSTSUSP) becomes approximately 300 μs±50 μs and also control the scan driver 203 and the sustain driver 204 so that a rising period and a falling period of each of the sustain pulses (FSTSUSP, SUSP, LSTSUSP) becomes approximately 340 ns±20 ns. The timing controller 201 controls the scan driver 203 and the sustain driver 204 so that the positive sustain voltage (Vs) is applied to the sustain electrodes Z prior to the first Y negative ramp waveform (NRY1).

The driving voltage generator 205 generates the driving voltages supplied to the PDP 200, i.e., the voltages (Vry, Vs, −V1, −V2, −Vy, Va, Vyb, Vzb) shown in FIGS. 6, 8 and 14 to 23. These driving voltages can be varied depending on a discharge characteristic or the composition of a discharge gas, which are different depending on the resolution, model, etc. of the PDP 200.

The invention being thus described, may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus, comprising:

a Plasma Display Panel (PDP) including scan electrodes and sustain electrodes;

a controller for controlling a time period between a last sustain pulse, which is applied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP; and a driver for applying a ground voltage to the sustain electrodes during an entire portion of a reset period of the $n^{th}$ sub-field and for applying a bias voltage to the sustain electrodes during an entire portion of an address period of the $n^{th}$ sub-field.

2. The plasma display apparatus as claimed in claim 1, wherein the controller to increase the time period as the temperature of the PDP or the ambient temperature of the PDP increases.

3. The plasma display apparatus as claimed in claim 2, wherein the time period is in a range of approximately 100 μs to 1 ms.

4. The plasma display apparatus as claimed in claim 1, wherein the controller is adapted to control a rising period and a falling period of a sustain pulse to be approximately 320 ns to 360 ns when the temperature of the PDP or the ambient temperature of the PDP is greater than room temperature.

5. The plasma display apparatus as claimed in claim 1, wherein a width of the last sustain pulse is 1 μs to 1 ms.

6. The plasma display apparatus as claimed in claim 1, wherein after the last sustain pulse is applied to the scan electrodes or the sustain electrodes, a voltage of the scan electrodes or the sustain electrodes is maintained at a ground level during a remaining portion of the sustain period.

7. The plasma display apparatus as claimed in claim 6, wherein a time period during which the voltage of the scan electrodes or the sustain electrodes is maintained at the ground level is 100 μs to 1 ms.

8. The plasma display apparatus as claimed in claim 1, wherein the driver to apply a positive ramp waveform to the scan electrodes or the sustain electrodes during an erase period of the $(n-1)^{th}$ sub-field.

9. The plasma display apparatus as claimed in claim 1, wherein the time period is determined according to a width of the last sustain pulse.

10. A driving method of a plasma display apparatus that drives a plasma display panel (PDP) including scan electrodes and sustain electrodes, the method comprising:

controlling a period between a last sustain pulse, which is supplied to the scan electrodes or the sustain electrodes during a sustain period of a $(n-1)^{th}$ sub-field (where n is a positive integer), and an initialization signal, which is applied to the scan electrodes during a reset period of an $n^{th}$ sub-field, depending on a temperature of the PDP or an ambient temperature of the PDP; and applying a ground voltage to the sustain electrodes during an entire portion of a reset period of the $n^{th}$ sub-field and applying a bias voltage to the sustain electrodes during an entire portion of an address period of the $n^{th}$ sub-field.

11. The driving method as claimed in claim 10, wherein the period is approximately 100 μs to 1 ms.

12. The driving method as claimed in claim 10, wherein a rising time period and a falling time period of a sustain pulse applied to the scan electrodes or the sustain electrodes during the sustain period is approximately 320 ns to 360 ns.

13. The driving method as claimed in claim 10, wherein a width of the last sustain pulse is 1 μs to 1 ms.

14. The driving method as claimed in claim 10, wherein after supplying the last sustain pulse to the scan electrodes or the sustain electrodes is finished, a voltage of the scan electrodes or the sustain electrodes is maintained at a ground level during a remaining portion of the sustain period.

15. The driving method as claimed in claim 14, wherein a time period during which the voltage of the scan electrodes or the sustain electrodes is maintained at the ground level is 100 μs to 1 ms.

16. The driving method as claimed in claim 10, wherein the controlling includes increasing the period as the temperature of the PDP or the ambient temperature of the PDP increases.

17. The driving method as claimed in claim 10, further comprising:

applying a positive ramp waveform to the scan electrodes or the sustain electrodes during an erase period of the $(n-1)^{th}$ sub-field.

18. A plasma display apparatus, comprising:

a Plasma Display Panel (PDP) that includes a scan electrode and a sustain electrode;

a driver to apply a pre-reset waveform to the scan electrode or the sustain electrode prior to a reset period of at least one sub-field of a frame, the pre-reset waveform including a negative ramp waveform; and a controller for controlling a time interval between an onset of the pre-reset period and an onset of the negative ramp waveform based on at least one of a temperature of the PDP and an ambient temperature of the PDP.

19. The plasma display apparatus as claimed in claim 18, wherein the controller to control a rising period and a falling period of a sustain pulse to be approximately 320 ns to 360 ns when at least one of the temperature of the PDP and the ambient temperature of the PDP is greater than room temperature.

20. The plasma display apparatus as claimed in claim 18, wherein the driver to apply the pre-reset waveform prior to a reset period of a sub-field having a lowest gray value weight among the sub-fields.

21. A method for driving a plasma display panel (PDP) having a scan electrode and a sustain electrode, the method comprising:

generating a pre-reset waveform having a negative ramp waveform;

applying the pre-reset waveform to one of the scan electrode and the sustain electrode prior to a reset period of one or more sub-fields of a frame; and controlling a time interval between an onset of the pre-reset period and an onset of the negative ramp waveform based on at least one of a temperature of the PDP and an ambient temperature of the PDP.

22. The method as claimed in claim 21, further comprising:

controlling a rising period and a falling period of a sustain pulse to be approximately 320 ns to 360 ns when at least one of the temperature of the PDP and the ambient temperature of the PDP is greater than room temperature.

23. The method as claimed in claim 21, wherein applying the pre-reset waveform is performed prior to a reset period of a sub-field having a lowest gray value weight among the sub-fields.

24. A plasma display apparatus, comprising:

a Plasma Display Panel (PDP) that includes a scan electrode and a sustain electrode;

a controller for controlling a time interval between a rising point of a last sustain pulse, which is applied to one of the scan electrode and the sustain electrode during a sustain period of a $(n-1)^{th}$ sub-field, and an onset of an initialization signal, which is applied to the scan electrode during a reset period of an $n^{th}$ sub-field, depending on at least one of a temperature of the PDP and an ambient temperature of the PDP; and a driver for applying a ground voltage to the sustain electrode during a setup period of the $n^{th}$ sub-field, for applying a negative ramp waveform to the sustain electrode during a setdown period of the $n^{th}$ sub-field, and for applying a bias voltage to the sustain electrode during an entire portion of an address period of the $n^{th}$ sub-field.

25. The plasma display apparatus as claimed in claim 24, wherein a width of the last sustain pulse is 300±50 μs.

* * * * *